US009157698B2

(12) United States Patent
Cosentino

(10) Patent No.: US 9,157,698 B2
(45) Date of Patent: Oct. 13, 2015

(54) KINEMATIC MOUNT

(71) Applicant: Timothy Cosentino, Waitsfield, VT (US)

(72) Inventor: Timothy Cosentino, Waitsfield, VT (US)

( * ) Notice: Subject to any disclaimer, the term of this patent is extended or adjusted under 35 U.S.C. 154(b) by 0 days.

(21) Appl. No.: 13/896,216

(22) Filed: May 16, 2013

(65) Prior Publication Data

US 2013/0305584 A1 Nov. 21, 2013

Related U.S. Application Data

(60) Provisional application No. 61/688,522, filed on May 16, 2012.

(51) Int. Cl.

| | |
|---|---|
| ***F41C 27/00*** | (2006.01) |
| ***F41C 27/06*** | (2006.01) |
| ***F41G 1/387*** | (2006.01) |
| ***F41G 11/00*** | (2006.01) |

(52) U.S. Cl.

CPC ..... *F41C 27/00* (2013.01); *F41C 27/06* (2013.01); *F41G 1/387* (2013.01); *F41G 11/006* (2013.01); *Y10T 29/49826* (2015.01)

(58) Field of Classification Search

CPC ... F41G 11/001; F41G 11/003; F41G 11/004; F41G 11/005; F41G 11/006; F41G 11/007; F41G 11/008

USPC ..... 42/111, 119, 124, 125, 126, 127, 128; 89/41.17, 41.19, 200; 248/181.1; 403/374.3

See application file for complete search history.

(56) References Cited

U.S. PATENT DOCUMENTS

| | | | | | |
|---|---|---|---|---|---|
| 4,409,738 | A | * | 10/1983 | Renander et al. | 33/281 |
| 4,696,596 | A | * | 9/1987 | Russell | 403/321 |
| 5,101,590 | A | * | 4/1992 | Hawkins | 42/111 |
| 5,390,419 | A | * | 2/1995 | Sirkis | 42/127 |

(Continued)

FOREIGN PATENT DOCUMENTS

WO 2013/173646 A1 11/2013

OTHER PUBLICATIONS

Slocum et al., "Kinematic Couplings and Elastic Averaging: Precision, Intelligent, Low Cost Interfaces with Medical Applications?", MIT Dept. of Mechanical Eng., Precision Engineering Research Group, 30 pages, http://pergatory.mit.edu/kinematiccouplings/index.htm, May 8, 2001.

(Continued)

*Primary Examiner* — Bret Hayes

(74) *Attorney, Agent, or Firm* — Taft Stettinius & Hollister, LLP; Anthony P. Filomena

(57) ABSTRACT

A mounting device for use with a firearm comprising: (a) a first frame; (b) a second frame, where the first frame and the second frame collectively include a first sphere and a second sphere, where the first frame and the second frame collectively include a first receiver configured to restriction motion of the first sphere in at least one degree of freedom, where the first frame and the second frame collectively include a second receiver configured to restriction motion of the second sphere in at least one degree of freedom, and where the first frame and the second frame collectively include a projection and a lock configured to engage the projection and: (a) restrict motion of the first sphere in a degree of freedom not restricted by the first receiver, and (b) restrict motion of the second sphere in a degree of freedom not restricted by the second receiver.

25 Claims, 25 Drawing Sheets

(56) References Cited

U.S. PATENT DOCUMENTS

| | | | | |
|---|---|---|---|---|
| 5,711,647 | A | 1/1998 | Slocum | |
| 6,000,667 | A * | 12/1999 | Isbell et al. | 248/201 |
| 6,193,430 | B1 | 2/2001 | Culpepper et al. | |
| 6,729,589 | B2 | 5/2004 | Shelef | |
| 7,204,052 | B2 | 4/2007 | Swan | |
| 7,523,583 | B2 * | 4/2009 | Cheng | 42/146 |
| 2003/0056417 | A1 | 3/2003 | Horton | |
| 2009/0257819 | A1 | 10/2009 | Burton | |
| 2013/0283659 | A1 * | 10/2013 | Trapp et al. | 42/111 |

OTHER PUBLICATIONS

Robertson et al., "Precision Robot Calibration Using Kinematically Placed Inclinometers", MIT Dept. of Mechanical Eng., Precision Engineering Research Group, 10 pages, http://pergatory.mit.edu/kinematiccouplings/index.htm, Nov. 10, 2001.

Willoughby, Patrick; "Design of a Precision Robot Wrist Interface", MIT Dept. of Mechanical Eng., Precision Engineering Research Group, 28 pages, http://pergatory.mit.edu/kinematiccouplings/index.htm, 2002.

Willoughby, Patrick; "Kinematic Alignment of Precision Robotic Elements in Factory Environments:Abstract", MIT Dept. of Mechanical Eng., Precision Engineering Research Group, 2 pages, http://pergatory.mit.edu/kinematiccouplings/documents/Theses/willoughby_thesis/index.htm, Jan. 18, 2002.

Willoughby, Patrick; "Kinematic Alignment of Precision Robotic Elements in Factory Environments:Chapter 1", MIT Dept. of Mechanical Eng., Precision Engineering Research Group, 3 pages, http://pergatory.mit.edu/kinematiccouplings/documents/Theses/willoughby_thesis/index.htm, Jan. 18, 2002.

Willoughby, Patrick; "Kinematic Alignment of Precision Robotic Elements in Factory Environments:Chapter 2", MIT Dept. of Mechanical Eng., Precision Engineering Research Group, 13 pages, http://pergatory.mit.edu/kinematiccouplings/documents/Theses/willoughby_thesis/index.htm, Jan. 18, 2002.

Willoughby, Patrick; "Kinematic Alignment of Precision Robotic Elements in Factory Environments:Chapter 3", MIT Dept. of Mechanical Eng., Precision Engineering Research Group, 15 pages, http://pergatory.mit.edu/kinematiccouplings/documents/Theses/willoughby_thesis/index.htm, Jan. 18, 2002.

Willoughby, Patrick; "Kinematic Alignment of Precision Robotic Elements in Factory Environments:Chapter 4", MIT Dept. of Mechanical Eng., Precision Engineering Research Group, 15 pages, http://pergatory.mit.edu/kinematiccouplings/documents/Theses/willoughby_thesis/index.htm, Jan. 18, 2002.

Willoughby, Patrick; "Kinematic Alignment of Precision Robotic Elements in Factory Environments:Chapter 5", MIT Dept. of Mechanical Eng., Precision Engineering Research Group, 2 pages, http://pergatory.mit.edu/kinematiccouplings/documents/Theses/willoughby_thesis/index.htm, Jan. 18, 2002.

Willoughby, Patrick; "Kinematic Alignment of Precision Robotic Elements in Factory Environments:References", MIT Dept. of Mechanical Eng., Precision Engineering Research Group, 3 pages, http://pergatory.mit.edu/kinematiccouplings/documents/Theses/willoughby_thesis/index.htm, Jan. 18, 2002.

Hale, LC; "Principles and Techniques for Designing Precision Machines: Chapter 6", MIT Dept. of Mechanical Eng., Ph.D. Thesis, Precision Engineering Research Group, pp. 174-224, http://pergatory.mit.edu/kinematiccouplings/documents/, Jan. 8, 1999.

Hale, LC; "Principles and Techniques for Designing Precision Machines: Chapter 7", MIT Dept. of Mechanical Eng., Ph.D. Thesis, Precision Engineering Research Group, pp. 224-242, http://pergatory.mit.edu/kinematiccouplings/documents/, Jan. 8, 1999.

Slocum, Alexander H., Chapter 7.7, Kinematic Couplings, p. 401, Precision Machine Design, Prentice-Hall: Englewood Cliffs, NJ, 1992.

Hale, Layton C. and Alexander H. Slocum, "Optimal Design Techniques for Kinematic Couplings," Precision Engineering, 25, 114-127, 2000.

Slocum, Alexander H., "Kinematic Couplings for Precision Fixturing—Part I: Formulation of Design Parameters," Precision Engineering, 10.2, 85-91, 1988.

Slocum, Alexander H. and Alkan Donmez, "Kinematic Couplings for Precision Fixturing—Part 2: Experimental Determination of Repeatability and Stiffness," Precision Engineering, 10.3, Jul. 1988.

Slocum, Alenxander H. "Design of Three-Groove Kinematic Couplings," Precision Engineering, 14.2, 67-76, 1992.

Culpepper, Martin L., "Design and Application of Compliant Quasi-Kinematic Couplings," Ph.D. Thesis, Massachusetts Institute of Technology, Cambridge, MA, 2000.

* cited by examiner

KINEMATIC MOUNT

CROSS REFERENCE TO RELATED APPLICATIONS

The present application claims the benefit of U.S. Provisional Patent Application Ser. No. 61/688,522, filed May 16, 2012, the disclosure of which is hereby incorporated by reference.

RELATED ART

1. Field of the Invention

The present disclosure is directed to mounting devices and methods of using the same. In particular, the instant disclosure includes a mounting device adapted for use with a firearm so that precision mounting of ancillary devices to the firearm is possible repeatedly so that the ancillary device occupies the same position each time with respect to the firearm.

2. Brief Discussion of Related Art

In the context of firearms, many firearms have mounted thereto ancillary devices or equipment. A common ancillary device is an optical device, such as a scope, that provides more accurate information to the user of the firearm as to where the projectile(s) of the firearm will end up after being fired from the firearm.

When using a scope with a firearm, the scope needs to be correlated to the firearm. This correlation is typically referred to as sighting in the gun. But this sighting takes considerable time, especially in the context of long range shooting, such as sniper shooting, which relies on accuracy. In addition, if a user of a firearm with a scope needs or desires to remove the scope from the firearm, the work that has gone into the sighting is lost. The reason for this is that present day firearm mounts are inherently inaccurate due to being over constrained. These mounts use three planes as a mating interface. Three planes cannot be manufactured such that the two halves mate perfectly.

Referring to FIG. 30, the interface between the two parts occur along multiple surfaces where each half of this system is supposed to mate perfectly with the other. But these surfaces are long thin sections that are inherently difficult to machine exactly flat, parallel, and at the correct angle. Machined parts are always slightly different part to part and these very slight imperfections prevent the parts from fitting together exactly. When the two halves are mated and clamped they end up in an "over constrained" state. An "over constrained" system is caused when the parts deform under clamping. This deformation results in a system that can have more than one solution. The amount of shift is a function of clamping force, number of clamps, and more importantly parallelism, warp, and twist inherent in the parts due to the manufacturing processes.

Axial shift also plays an important role in final position. This weapon mount system does not have precision axial stops where the mount can be repeatably located. When the mount is removed from the rail and remounted the axial location can be different. If it has shifted then the surface to surface contact points have changed slightly with respect to its original alignment to the weapon. In addition to the change in contact surfaces the underlining structure and load path has shifted. Now when clamped the mount deforms to the rail or the rail deforms to the mount in a slightly different way than when it was originally boresighted. The elastic nature of metal ensures that the mount/rail will easily deform under the clamping forces into a new shape.

In all the cases listed above these may appear as very small local changes but are greatly amplified at the 300 m to 1 km (or longer) distances that weapon mount devices are intended to work at. All this adds up to an inherently inaccurate system.

INTRODUCTION TO THE INVENTION

It is a first aspect of the present invention to provide a mounting device for use with a firearm comprising: (a) a first frame; (b) a second frame, where the first frame and the second frame collectively include a first sphere and a second sphere, where the first frame and the second frame collectively include a first receiver configured to restriction motion of the first sphere in at least one degree of freedom, where the first frame and the second frame collectively include a second receiver configured to restriction motion of the second sphere in at least one degree of freedom, and where the first frame and the second frame collectively include a projection and a lock configured to engage the projection and: (a) restrict motion of the first sphere in a degree of freedom not restricted by the first receiver, and (b) restrict motion of the second sphere in a degree of freedom not restricted by the second receiver.

In a more detailed embodiment of the first aspect, the first frame includes the first sphere and the second sphere, and the second frame includes the first receiver and the second receiver. In yet another more detailed embodiment, the first frame includes the first sphere and the second receiver, and the second frame includes the first receiver and the second sphere. In a further detailed embodiment, the first sphere is part of a first ball stud, and the second sphere is part of a second ball stud. In still a further detailed embodiment, the projection includes a third sphere, and the lock includes a third receiver to engage the third sphere. In a more detailed embodiment, the first receiver is configured to restriction motion of the first sphere in at least one of a first direction, in a second direction perpendicular to the first direction, and rotational motion, and the second receiver is configured to restriction motion of the second sphere in at least one of a first direction, in a second direction perpendicular to the first direction, and rotational motion. In a more detailed embodiment, the first receiver is configured to restriction motion of the first sphere in the first direction and allow motion of the first sphere in the second direction perpendicular to the first direction and rotational motion of the first sphere, and the second receiver is configured to restriction motion of the second sphere in the first direction and allow motion of the second sphere in the second direction perpendicular to the first direction and rotational motion of the second sphere. In another more detailed embodiment, the first sphere is part of a first ball stud removably coupled to the first frame, and the second sphere is part of a second ball stud removably coupled to the first frame. In yet another more detailed embodiment, the projection comprises a third sphere. In still another more detailed embodiment, the third sphere is part of a third ball stud removably coupled to the first frame.

In yet another more detailed embodiment of the first aspect, the third sphere is part of a third ball stud removably coupled to the second frame. In still another more detailed embodiment, the first receiver includes a first pair of control arms operative to at least partially delineate a first cylindrical channel that is configured to slidably receive the first sphere, and the second receiver includes a second pair of control arms operative to at least partially delineate a second cylindrical channel that is configured to slidably receive the second sphere. In a further detailed embodiment, the first cylindrical channel is at least partially delineated by a first insert mounted to the first frame, and the second cylindrical channel is at least partially delineated by a second insert mounted to the first frame. In still a further detailed embodiment, the first cylindrical channel includes a first longitudinal axis that is angled between ninety and one hundred and eighty degrees with respect to a second longitudinal axis of the second cylinder. In a more detailed embodiment, the first sphere is angled between ninety and one hundred and eighty degrees with respect to the second sphere. In a more detailed embodiment, the lock includes an arcuate surface to contact the third sphere on more than one peripheral location on an exterior of the third sphere, and at least one of the first sphere and the second sphere is angled between twenty-five and one hundred and eighty degrees with respect to the third sphere. In another more detailed embodiment, the lock is associated with the second frame, the third sphere is associated with the first frame, and the arcuate surface comprise multiple surfaces from multiple components. In yet another more detailed embodiment, the first pair of control arms are removably coupled to the first frame, and the second pair of control arms are removably coupled to the first frame.

It is a second aspect of the present invention to provide a method of mounting an ancillary device to a firearm comprising: (a) operatively coupling a first frame an ancillary device; (b) operatively coupling a second frame to a firearm; (c) operatively coupling the first frame to the second frame to allow the first frame to pivot with respect to the second frame; (d) locking the second frame to the first frame to inhibit pivoting of the first frame with respect to the second frame.

In a more detailed embodiment of the second aspect, the ancillary device is at least one of a scope, a laser, a flashlight, and a grenade launcher. In yet another more detailed embodiment, the firearm is at least one of a rifle and a pistol. In a further detailed embodiment, the second frame is configured to lock to the first frame in only a single position and orientation. In yet a further detailed embodiment, the method further comprises operatively coupling a third frame and a second ancillary device, unlocking and removing the first frame from the second frame, operatively coupling the third frame to the second frame to allow the third frame to pivot with respect to the second frame, and locking the second frame to the third frame to inhibit pivoting of the third frame with respect to the second frame It is a third aspect of the present invention to provide a mounting device comprising a first frame configured to rotationally engage a second frame about a first axis and thereafter pivotally engage the second frame about a second axis perpendicular to the first axis, wherein at least one of the first frame and the second frame includes a repositionable lock operative to selectively inhibit pivoting of the first frame with respect to the second frame.

In a more detailed embodiment of the third aspect, the first frame and second frame are configured to engage one another in only a signal position and orientation that inhibits rotational and pivotal motion therebetween.

DETAILED DESCRIPTION

The exemplary embodiments of the present disclosure are described and illustrated below to encompass mounting devices and methods of using the same. In particular, the instant disclosure includes a mounting device adapted for use with a firearm so that precision mounting of ancillary devices to the firearm is possible repeatedly so that the ancillary device occupies the same position each time with respect to the firearm. Of course, it will be apparent to those of ordinary skill in the art that the embodiments discussed below are exemplary in nature and may be reconfigured without departing from the scope and spirit of the present disclosure. However, for clarity and precision, the exemplary embodiments as discussed below may include optional steps, methods, and features that one of ordinary skill should recognize as not being a requisite to fall within the scope of the present disclosure.

Figure 1:
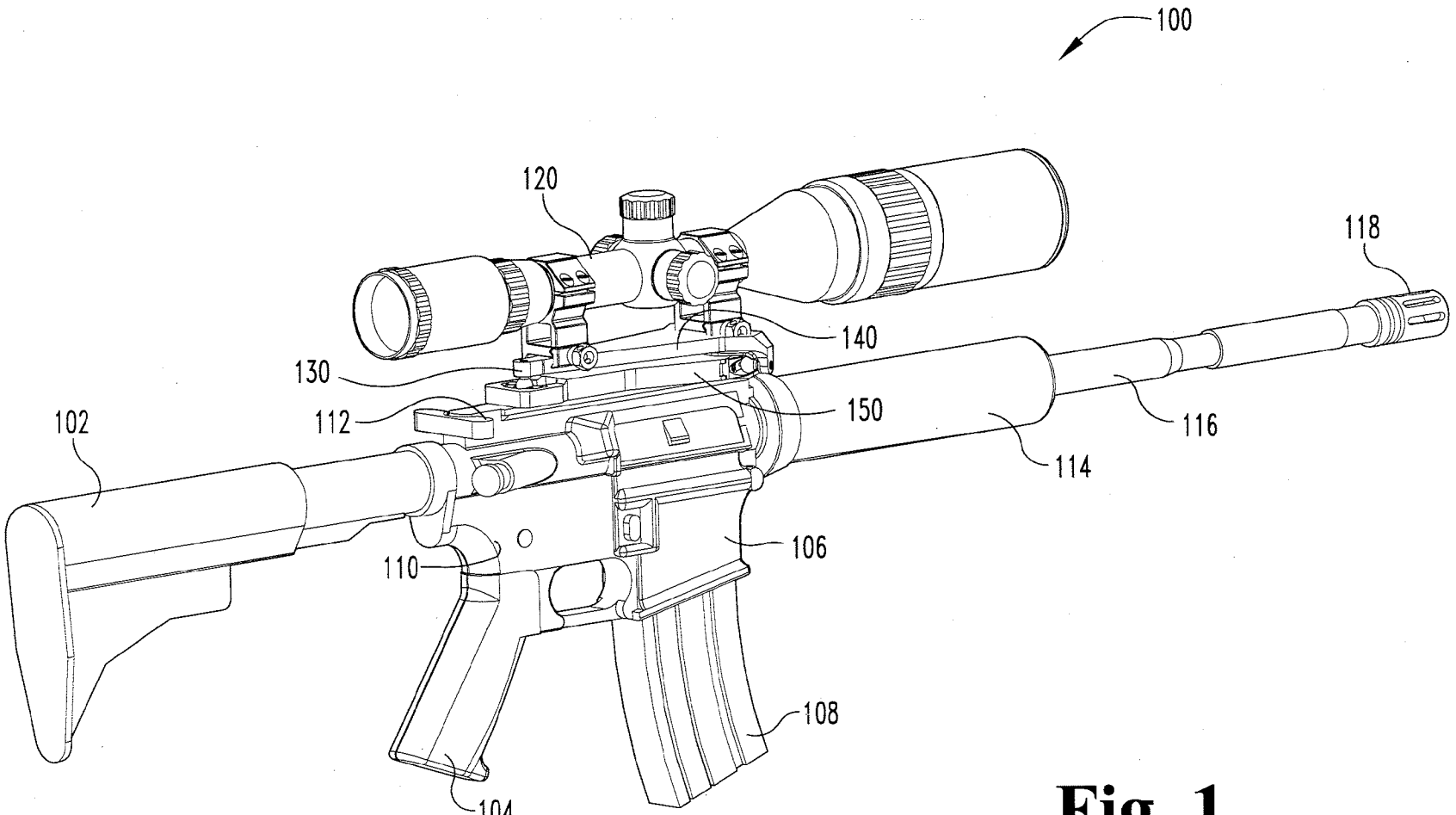
FIG. 1 is an elevated perspective view of a firearm that includes a scope mounted thereto using an exemplary mount in accordance with the instant disclosure.
Figure 2:
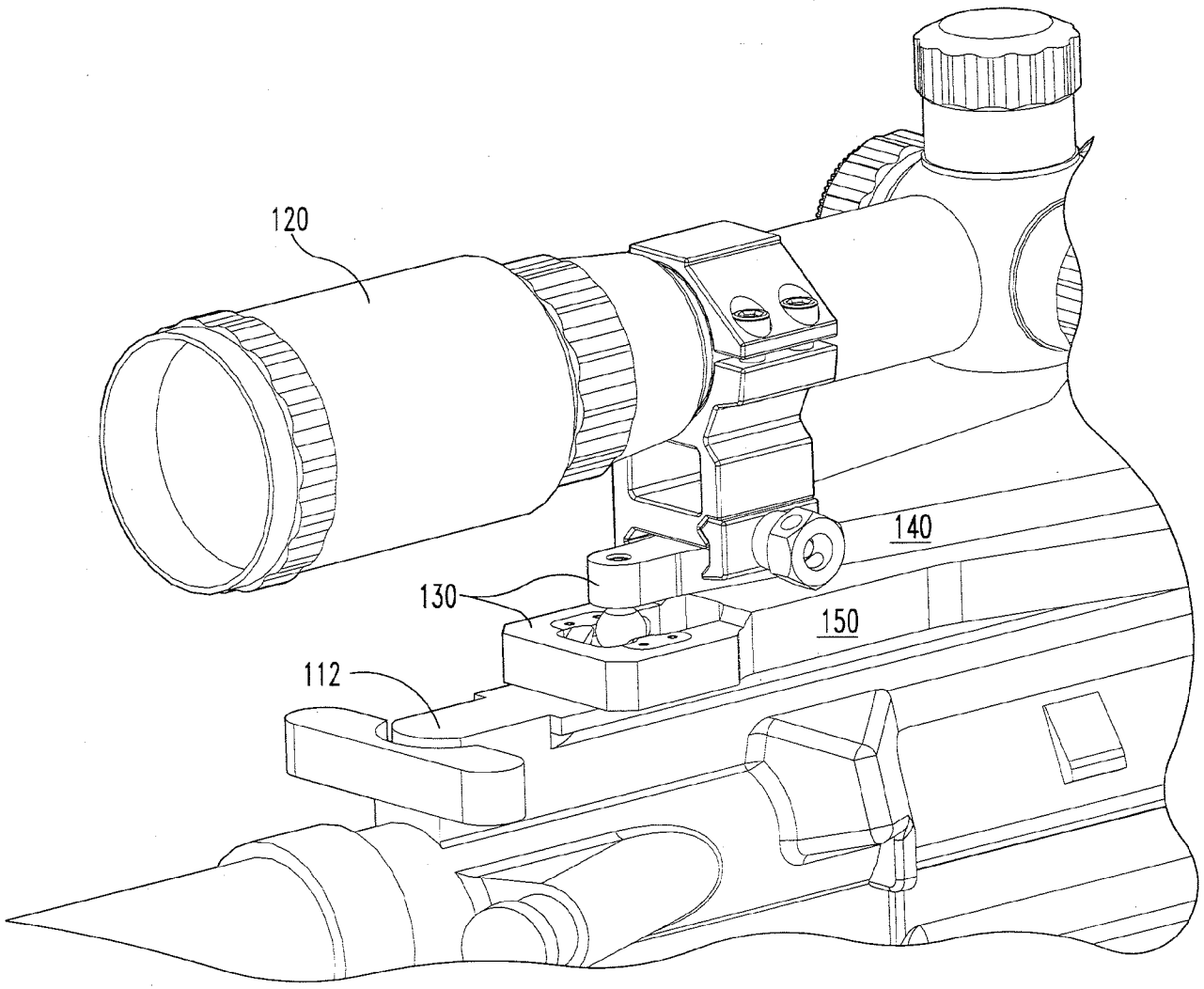
FIG. 2 is a magnified view of FIG. 1 showing a proximal portion of the exemplary mount and how a rifle scope is mounted thereto.

Referencing FIGS. 1 and 2, an exemplary firearm 100 includes a buttstock 102 that is operatively coupled to a pistol grip 104 and a magazine well 106. In exemplary form, the magazine well is configured to receive a magazine 108 in order to supply ammunition to the firing chamber. The firearm 100 also includes a lower receiver 110 that is separable from an upper receiver 112. The upper receiver 112 is mounted to a foregrip 116 from which a barrel 118 extends therethrough and terminating with a muzzle brake 118.

In this exemplary embodiment, the firearm 100 comprises an AR-15. Those skilled in the art will appreciate that other firearms may be used in lieu of an AR-15. Consequently, the use of an AR-15 is solely for exemplary description purposes and it should be understood that other firearms may be substituted in lieu of an AR-15. Likewise, the exemplary mounting devices disclosed herein may be used with any and all firearms, including rifles and pistols.

Returning to FIGS. 1 and 2, the firearm 100 also includes an optical device 120. In this case, the optical device 120 comprises a rifle scope. In order to mount the optical device 120 to the upper receiver 112 of the firearm 100, an exemplary mounting device 130 is utilized. As will be discussed in more detail herein, the exemplary mounting device 130 allows the optical device 120 to be initially mounted to the firearm 100, subsequently sighted in, and thereafter allow the optical device to be removed from the firearm and subsequently remounted to the firearm in the precise location it was originally mounted, thus obviating the need or desire to resight the firearm.

Figure 3:
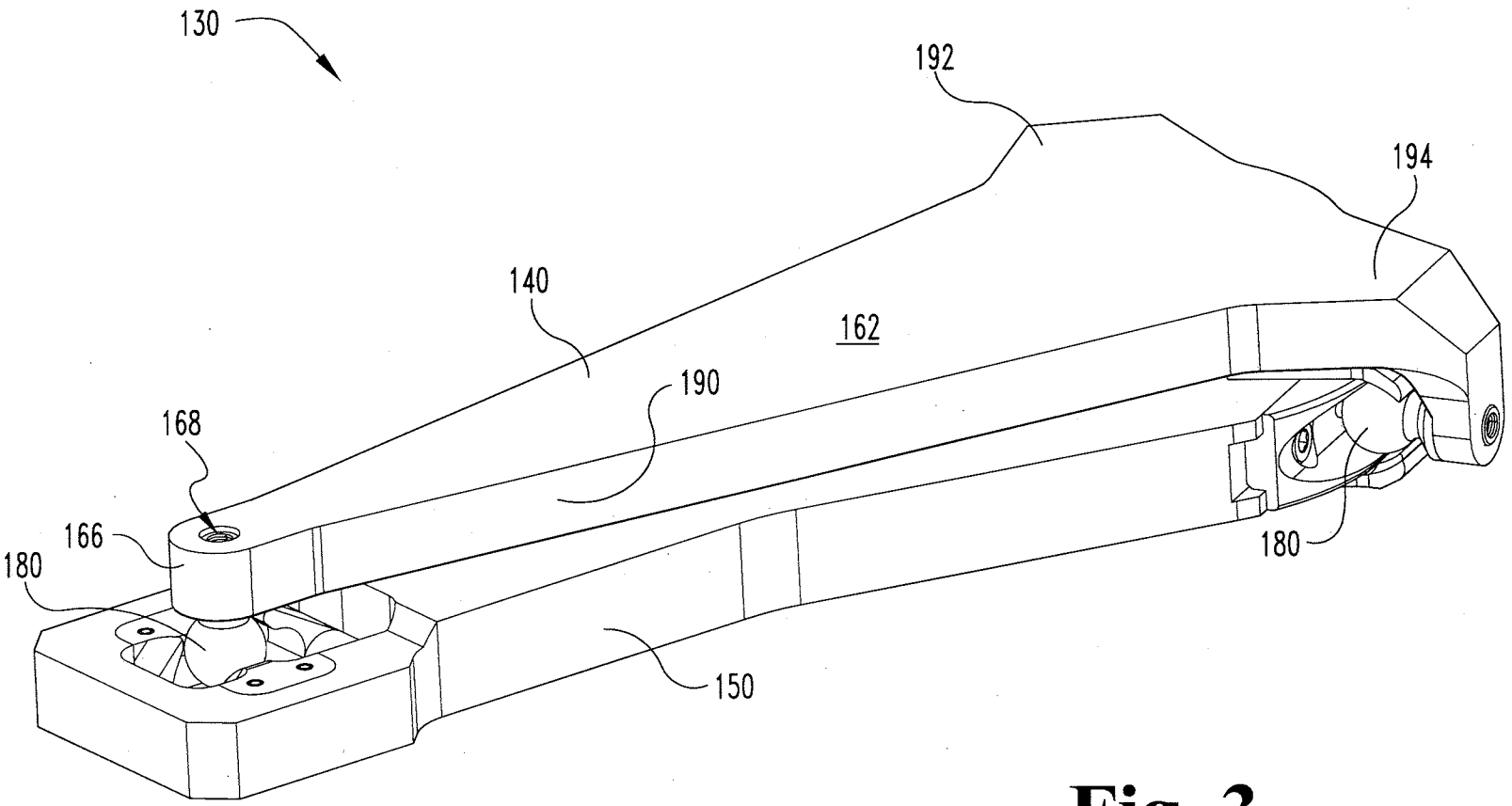
FIG. 3 is an elevated perspective view of the exemplary mount of FIG. 1
Figure 4:
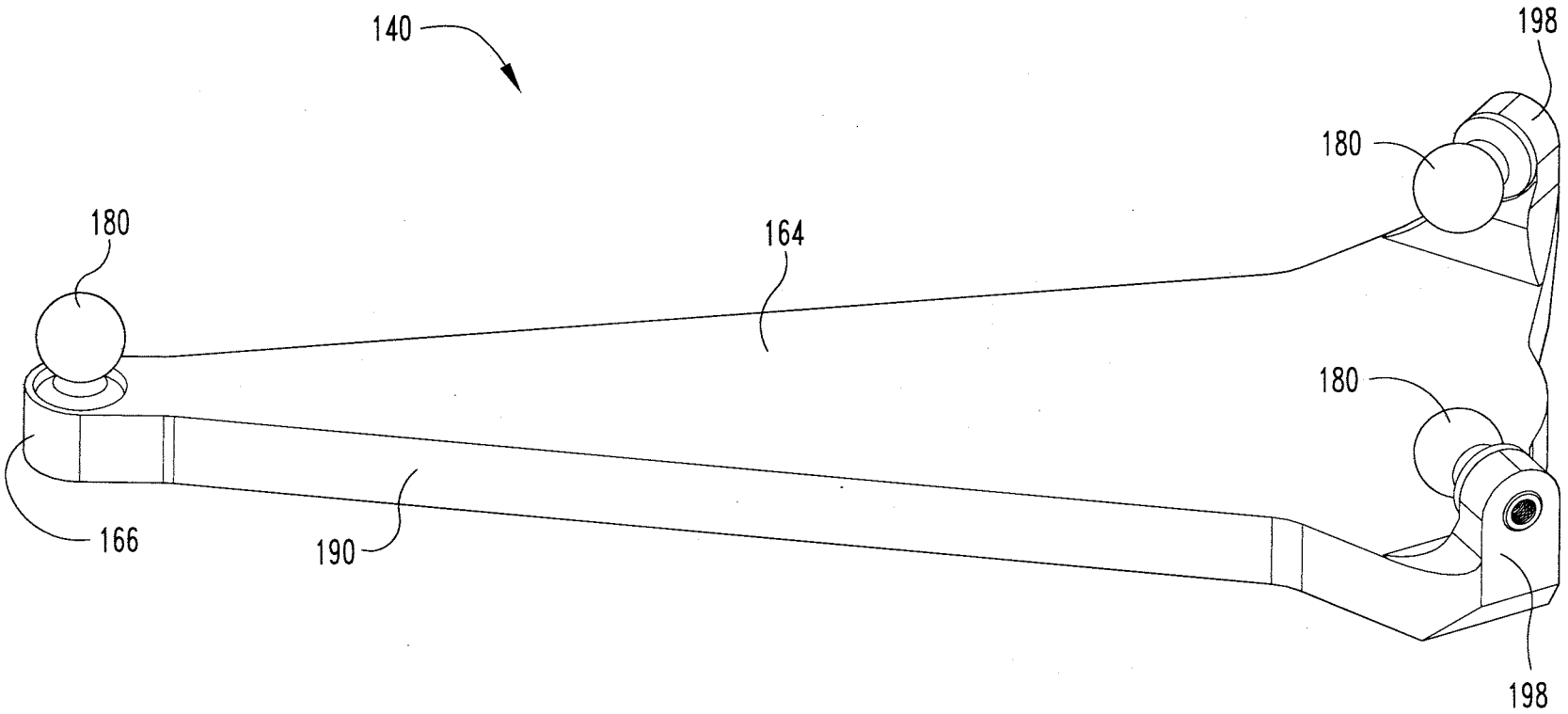
FIG. 4 is an elevated perspective view from below of a component of the mount of FIG. 3.
Figure 5:
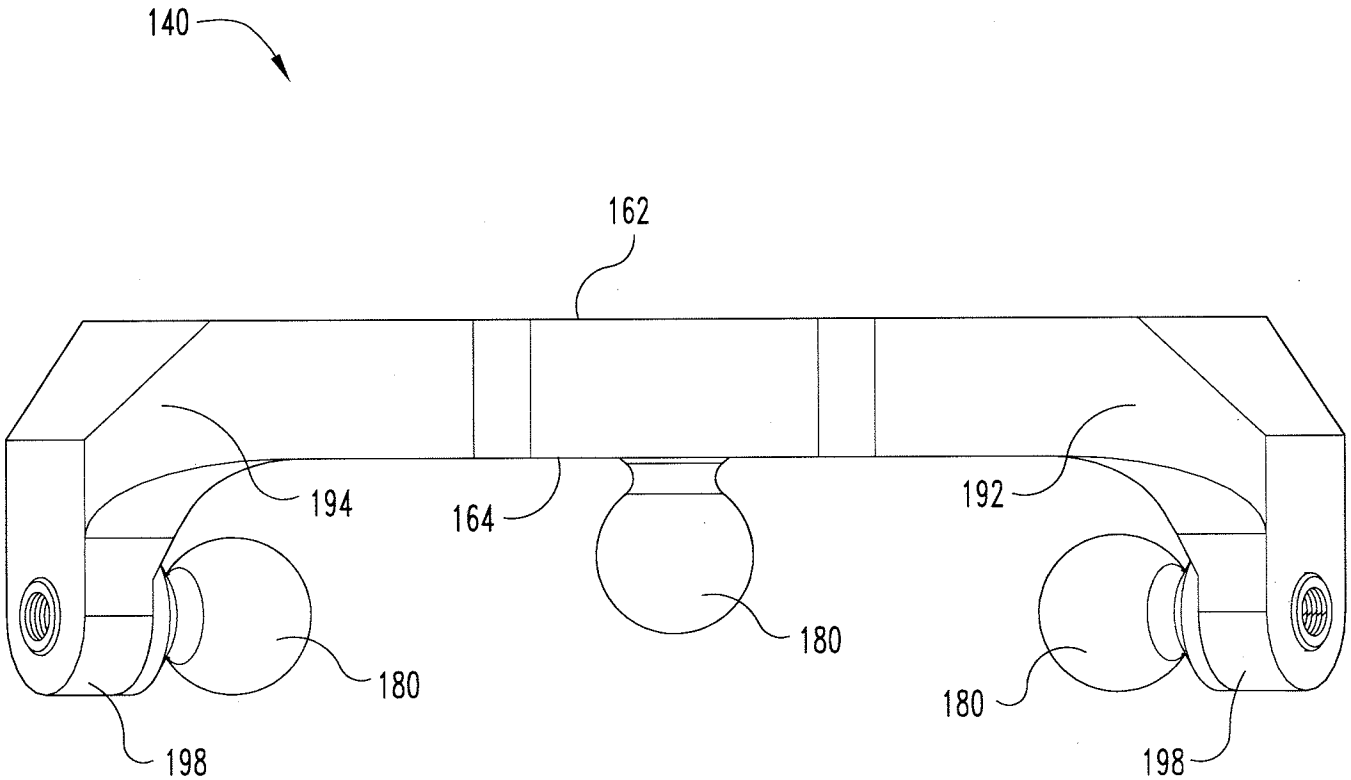
FIG. 5 is profile view of the component of FIG. 4, taken from the distal end.
Figure 6:
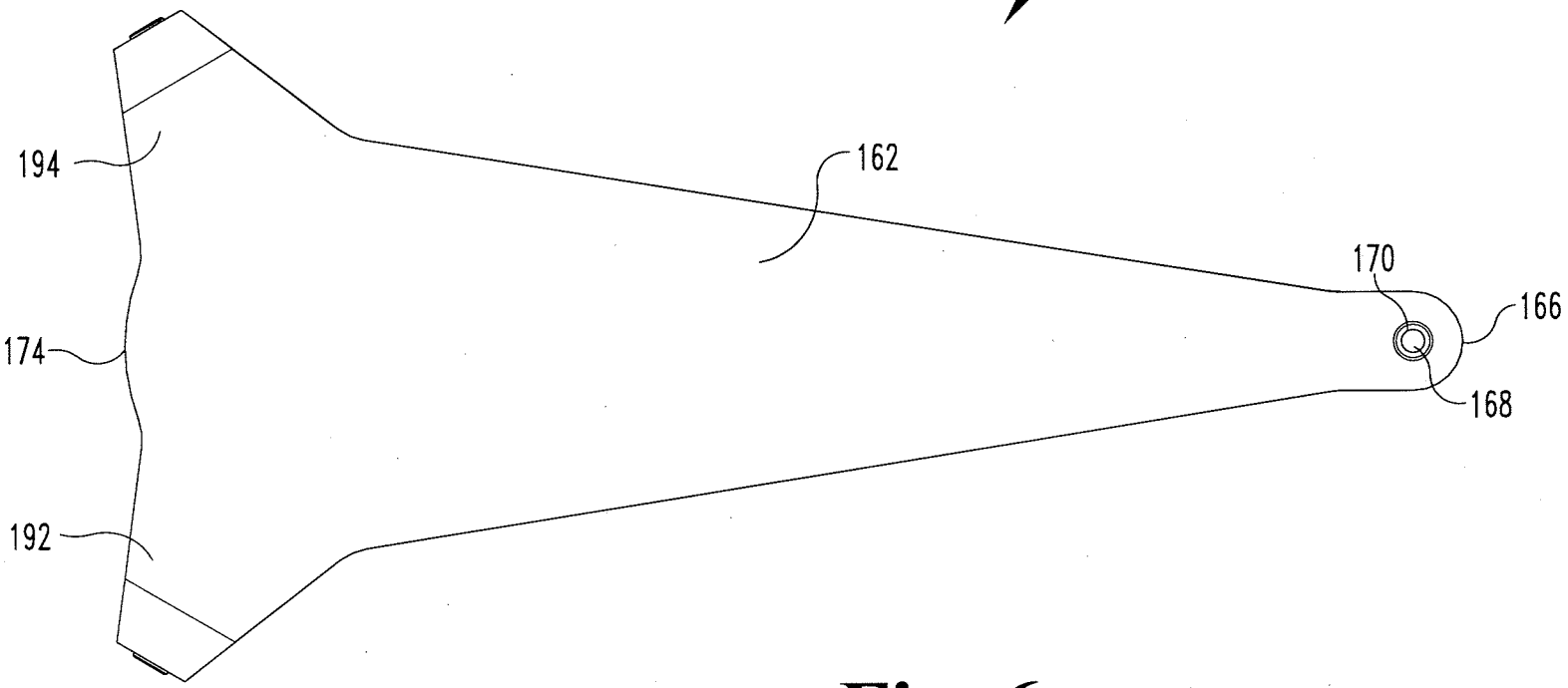
FIG. 6 is a top view of the component of FIG. 4.
Figure 7:
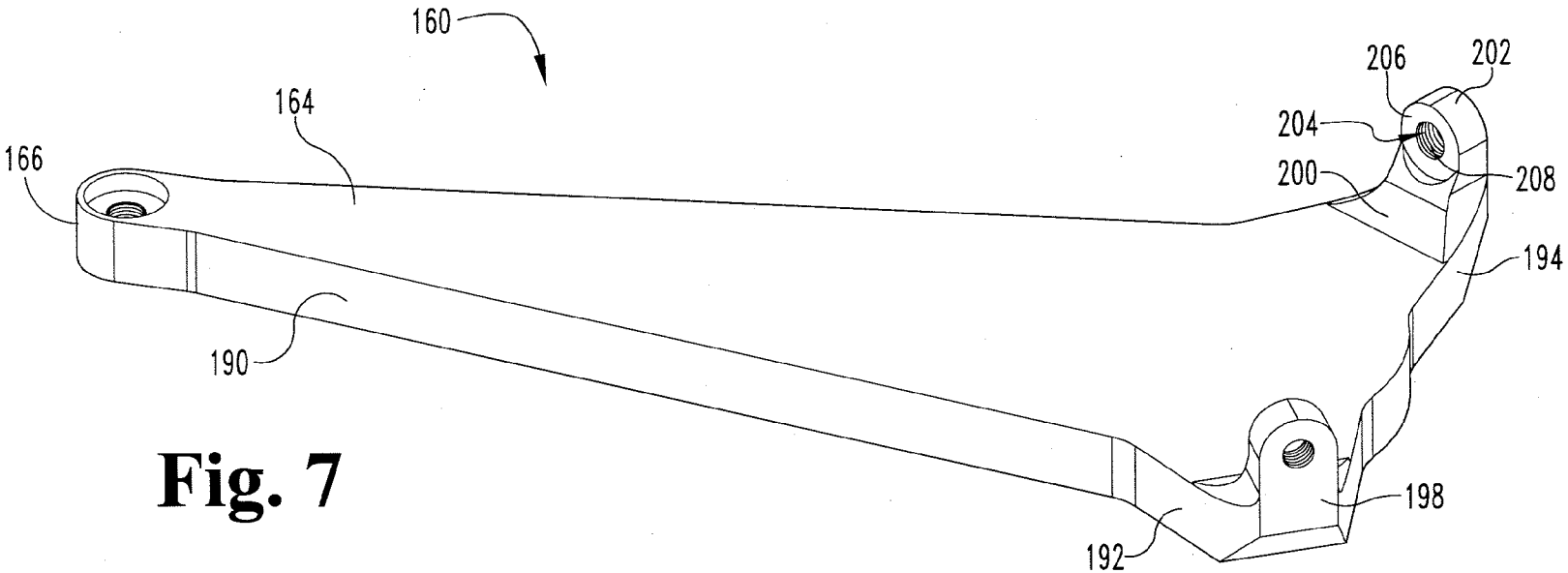
FIG. 7 is a recessed perspective view from below of a chassis of the component of FIG. 4.

Referring to FIG. 3, the exemplary mounting device 130 includes an ancillary device frame 140 that is configured to be mounted to an ancillary device. In addition, the mounting device 130 includes a firearm frame 150 that is configured to be mounted to the firearm, such as on the upper receiver 112 of the firearm. Though not required, the device frame may be permanently mounted to the ancillary device and/or the firearm frame 150 may be permanently mounted to the firearm. Alternatively, the device frame may be temporarily mounted to the ancillary device and/or the firearm frame 150 may be temporarily mounted to the firearm. Moreover, the ancillary device frame 140 may be integrated into an ancillary device, while the firearm frame 150 may be integrated into a firearm. What remains a constant, however, is that if the orientation and position of the device frame 140 with respect to an ancillary device (e.g., rifle scope, laser sight, illumination device, secondary weapon system/device, etc.) does not change and the orientation and the position of the firearm with respect to the firearm frame 150 does not change, the frames 140, 150 may be coupled and decoupled repeatedly so that each time the frames are coupled to one another the resulting orientation and position of the ancillary device and the firearm will be the same. As discussed above, this carries with it the advantage of not having to resight the firearm if the ancillary device is an optical device such as a scope.

Referencing FIGS. 4-8, the exemplary ancillary device frame 140 includes opposed top and bottom planar surfaces 162, 164. These planar surfaces 162, 164 taper in lateral width toward a proximal, rounded end 166, which is partially delineated by a peripheral side 190 having a substantially constant dimension, thereby resulting in the bulk of the frame 140 having a uniform thickness. Inset from this proximal end 166 is an orifice 168 that is at least partially delineated by helical threads 170. The orifice 168 does not have a uniform axial cross section because a portion of the orifice 168 includes an increased diameter to accommodate partial insertion of a ball stud 180.

Figure 8:
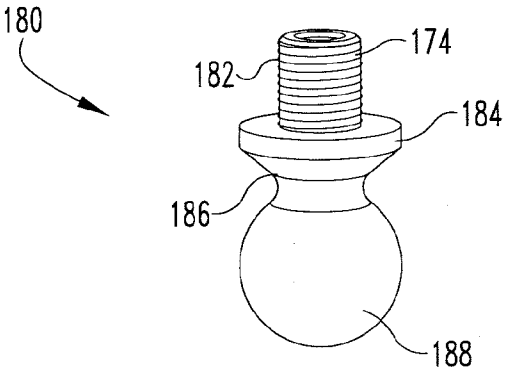
FIG. 8 is an elevated perspective view of a ball stud for from the component of FIG. 4.
Figure 9:
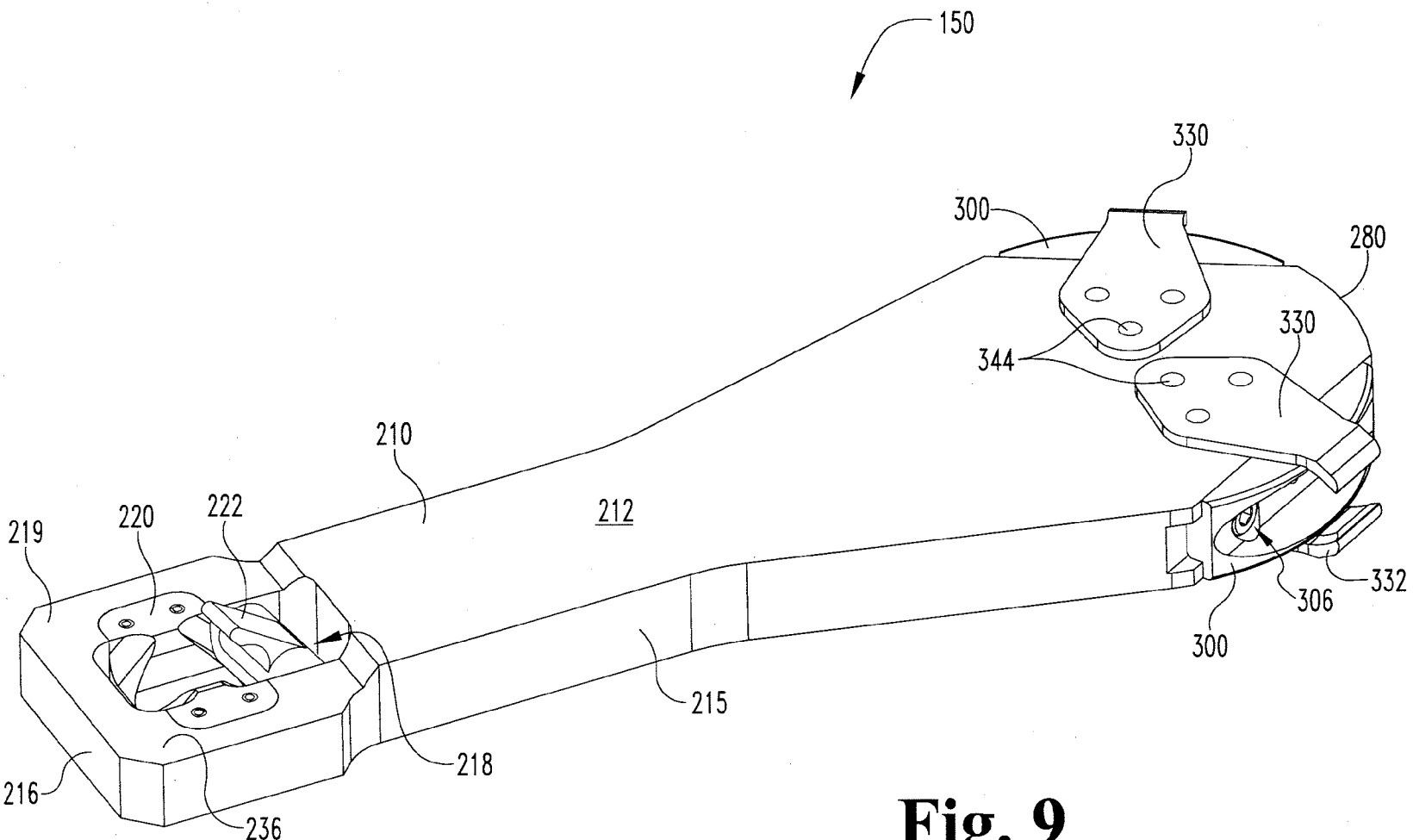
FIG. 9 is an elevated perspective view from above of another component of the mount of FIG. 3.
Figure 10:
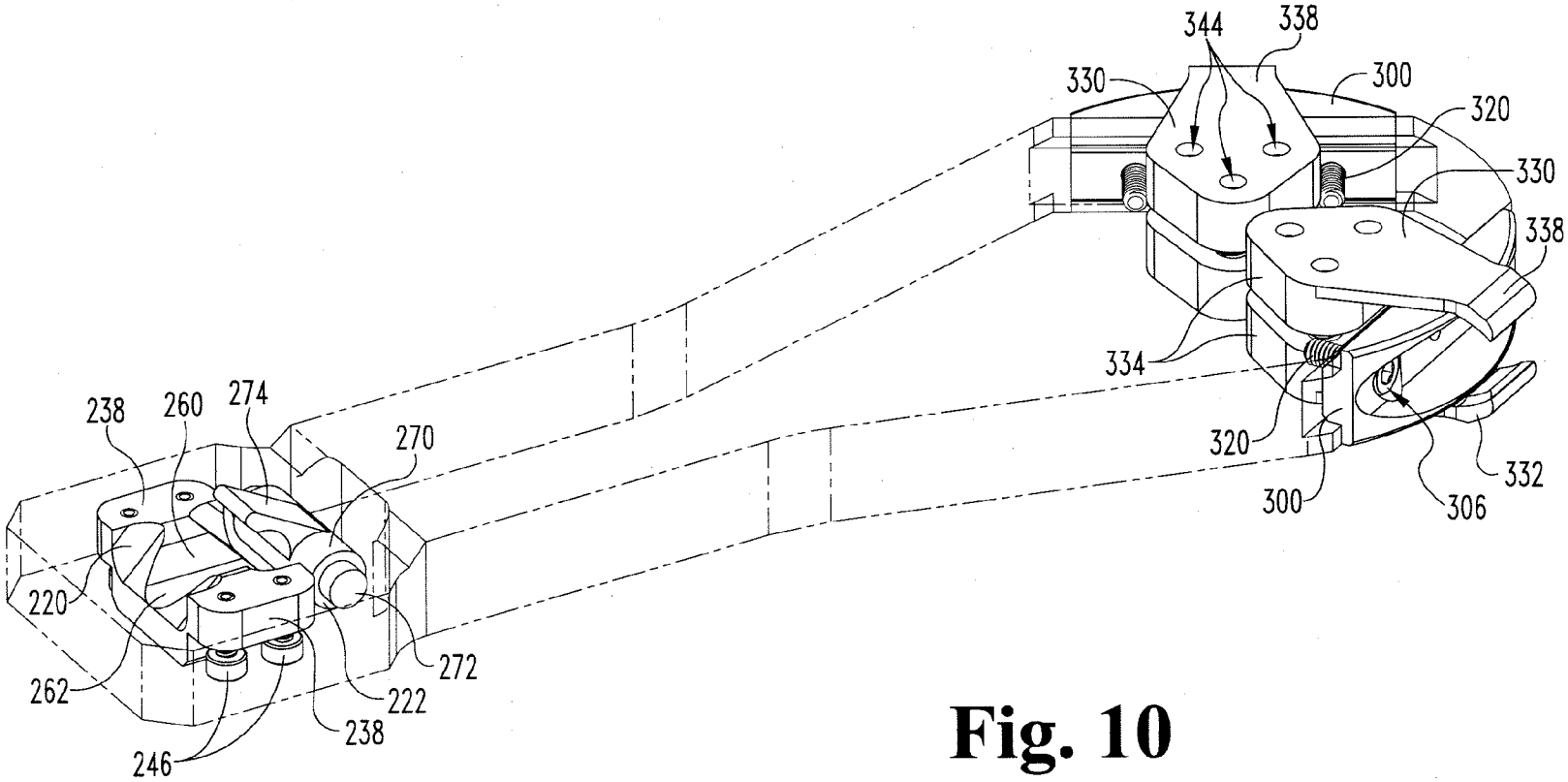
FIG. 10 an elevated perspective view from above of the other component of FIG. 9, with the chassis being shown as transparent.
Figure 11:
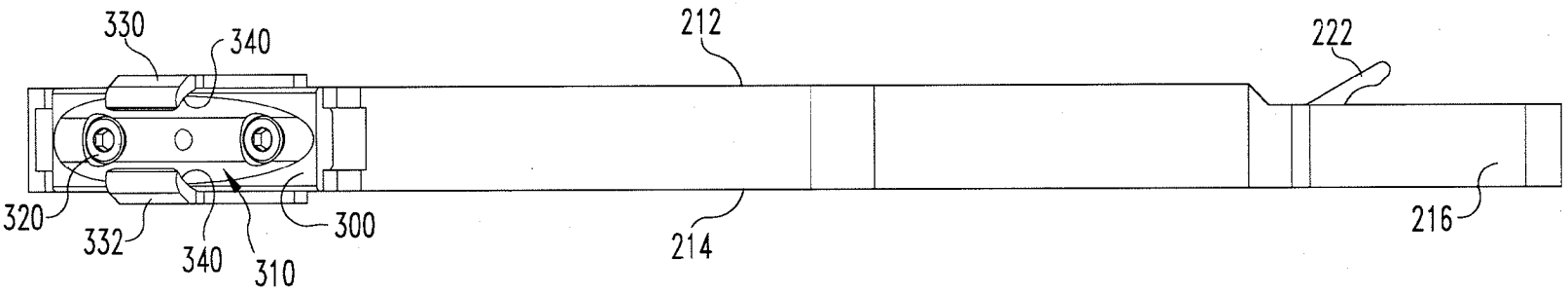
FIG. 11 is a profile view of the other component of FIG. 9.
Figure 12:
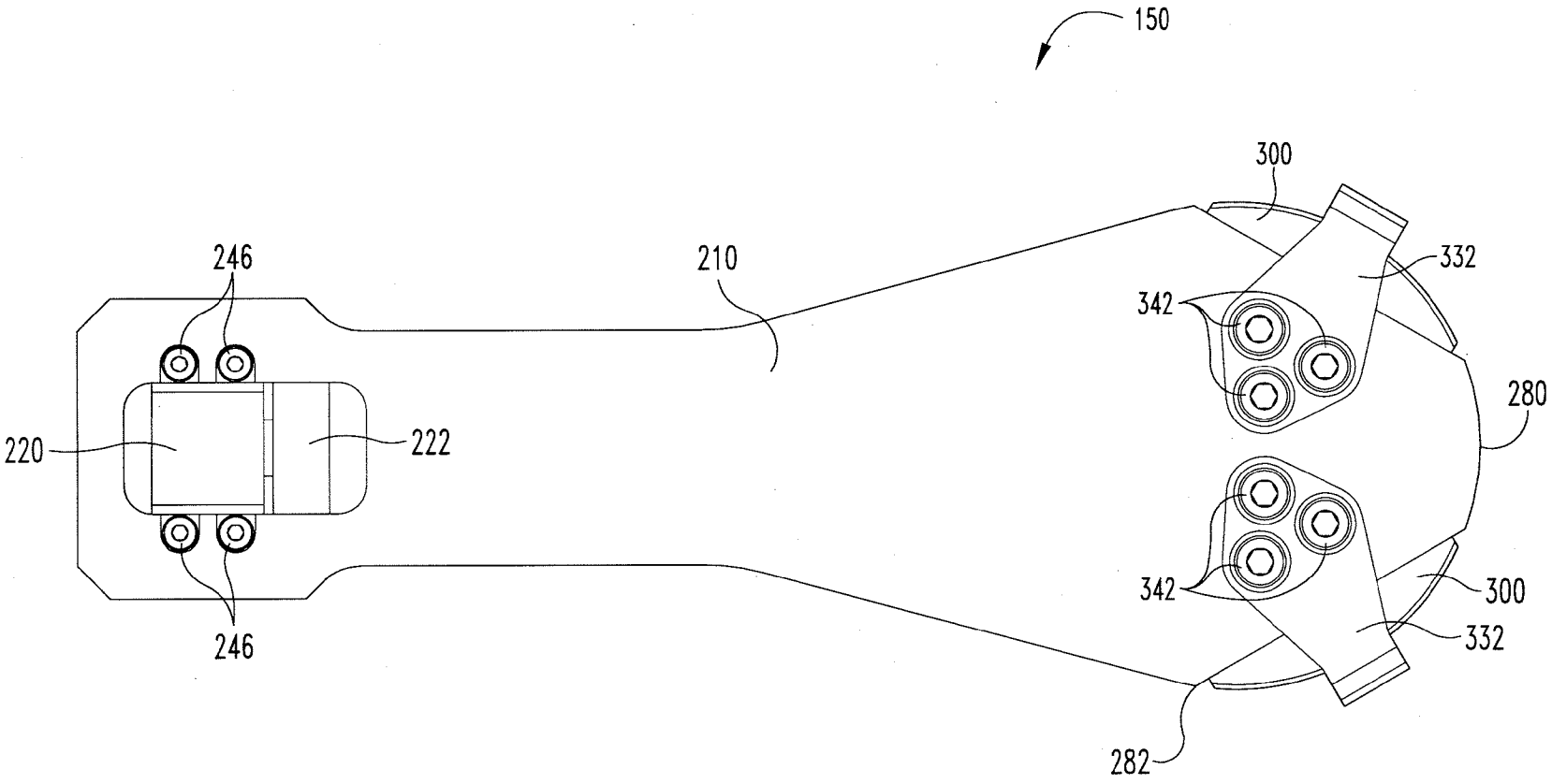
FIG. 12 is a bottom view of the other component of FIG. 9.
Figure 13:
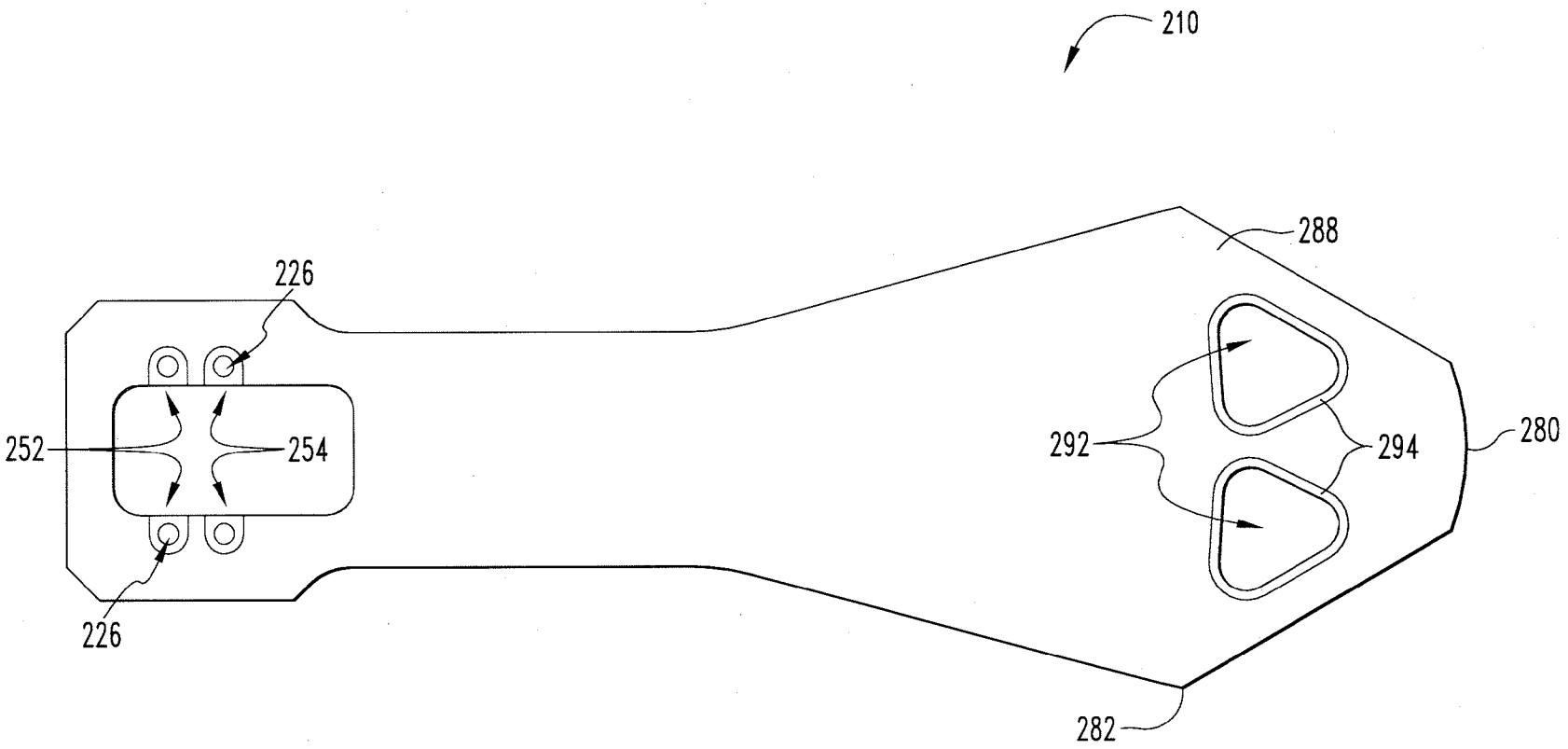
FIG. 13 is a bottom view of the chassis of FIG. 9.

Referring specifically to FIG. 8, an exemplary ball stud 180 includes a cylindrical section 182 that is circumscribed by a series of helical threads 174. These helical threads are configured to engage the helical threads 170 of the proximal orifice 168 in order to removably couple the ball stud 180 to the ancillary device frame 140. Adjacent the base of the cylindrical section 182 is a circumscribing flange 184 that transitions into an hour-glass shape neck 186 transitioning into a sphere 188. As will be discussed in more detail hereafter, the sphere is at least partially received by the firearm frame 150 in order to couple this frame to the ancillary device frame 140.

Referencing again FIGS. 3-7, the ancillary device frame 140 from overhead takes on a triangular shape having its widthwise dimension increase as the distance from the proximal end 166 increase. Eventually, when traveling from the proximal end 166 toward a distal end 174, the device frame 140 more drastically widens to form a pair of support arms 192, 194. Each support arm 192, 194 includes a sloped surface 200 that transitions between the bottom surface 164 and a raised projection 198 that is integral with respect to the frame. Those skilled in the art will understand that while various of the components of the exemplary mounting device 130 are described as integral or integrated, these same components may be fabricated to be removably coupled as well. Likewise, those skilled in the art will understand that while various of the components of the exemplary mounting device 130 are described as removably coupled to one another, these same components may be fabricated to be permanently attached as well.

Each raised projection 198 extends perpendicularly away from the bottom surface 164, but is angled in order to provide a corresponding angle for the respective ball stud 180 mounted thereto. In order to receive the ball stud 180, each raised projection 198 includes a planar ring surface 206 that circumscribes a through opening 204 that is at least partially threaded 208 to engage the threads 182 of the ball stud. Though not required, each raised projection 198 is rounded over at is bottom end 202.

Referring specifically to FIGS. 4-8, assembly of the ancillary device frame 140 include mounting three ball studs 180 to the frame chassis by engaging the helical threads 174 of a respective ball stud with the helical threads 170, 208 of a respective orifice 168, 204 and rotating the ball stud with respect to the chassis until the ball stud is secured. But the ball stud 180 mounted proximate the proximal end 166 is received deeper into the orifice 168 that are the ball studs mounted to the raised projections 198. This is because the orifice 168 is wide enough to accommodate partial throughput of the circumferential flange 184, whereas the remaining ball studs have their circumferential flanges exposed and adjacent the orifices 204 of the raised projections 198. Though not a design requirement, one, two, three, or none, or more of the ball studs may be recessed with respect to the chassis and raised projections 198, even though only one is recessed for purposes of exemplary explanation. Once the ball studs 180 are mounted to the chassis and raised projections 198, the balls studs take on a precise position and orientation. Specifically, the axial direction of the ball studs 180 mounted to the raised projections 198 are angled 120 degrees with respect to one another. Given the position of the third ball stud mounted proximate the proximal end 166, the three spheres 188 are oriented in a triangular configuration where the angles between the spheres are 120 degrees. As will be discussed in more detail hereafter, this triangular configuration is useful to ensure than that when the ancillary device frame 140 is properly mounted to the firearm frame 150, this proper mounting can only occur in a single manner, thereby ensuring the position and orientation of the ancillary device frame with respect to the firearm frame is the same each time.

It should be noted that the configuration of the three sphere and groove interface is not limited to 120 degree angles as the angles between the components may vary. What is important is the advantage that the frames be mounted to one another in a fashion that ensures the consistent position therebetween after the frames are disassembled and thereafter reassembled.

Referring to FIGS. 3 and 9-12, the exemplary firearm frame 150 includes a chassis 210 having opposed top and bottom planar surfaces 212, 214. Interposing these top and bottom surfaces 212, 214 is a peripheral, perpendicular surface 215 delineating a substantially constant thickness but for a proximal end portion 216. The proximal end portion 216 is slightly thinner in thickness, as delineated by an angled top surface 218 that transitions between the planar top surface 212 and a recessed top surface 219. This recessed top surface circumscribes a proximal opening 218 that takes on a rounded, rectangular shape. Within this opening 218 are positioned a flush insert 220 and a repositionable ball retainer 222.

Figure 14:
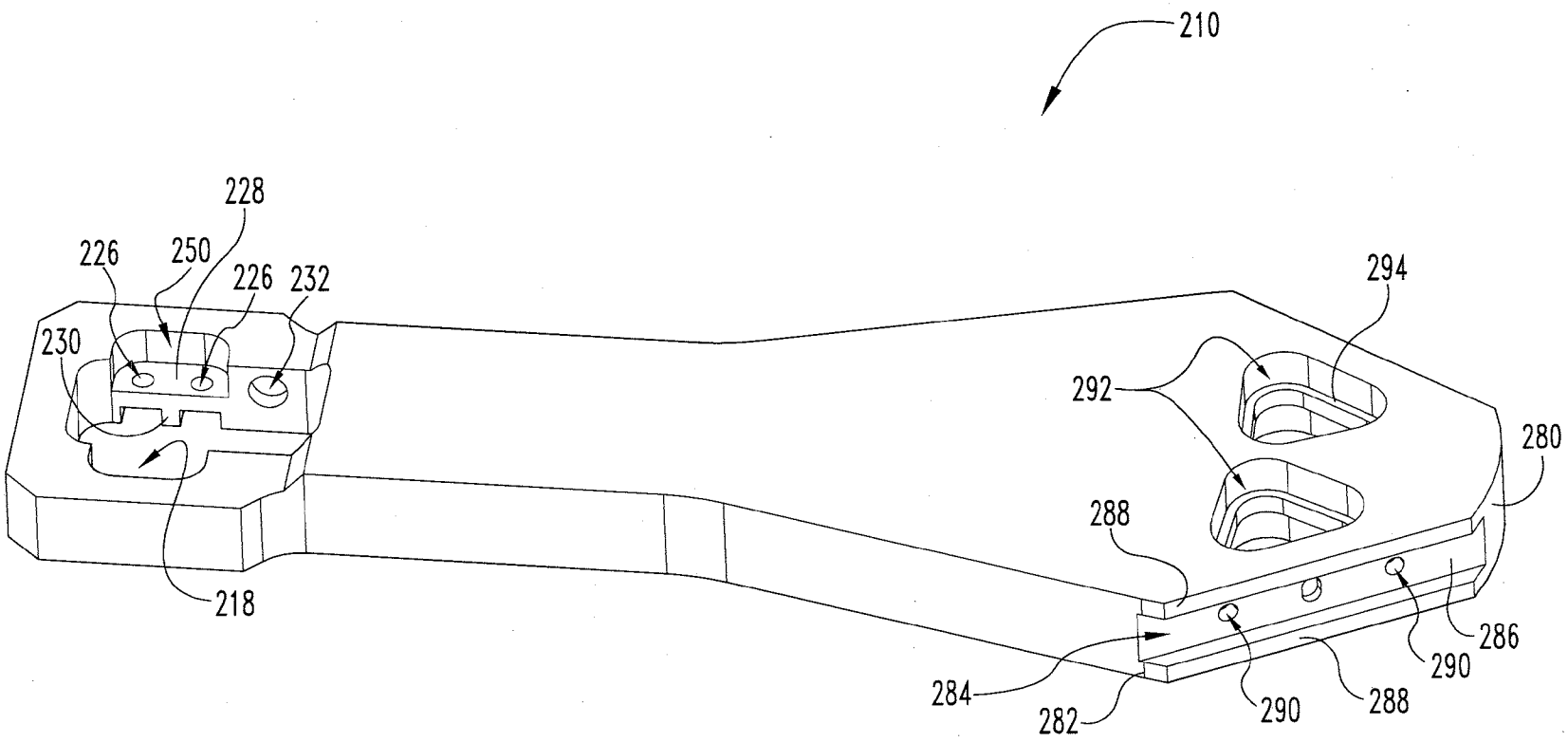
FIG. 14 is an elevated perspective view from above of the chassis of FIG. 9.

Referencing FIG. 14, the exemplary chassis 210 is fabricated to include three recesses 250, 252, 254 on opposing sides of the opening 218 to accommodate fasteners 246 and a portion of the flush insert 220. Specifically, the first recess includes an oblong, semi-circular shape partially delineated by a ledge 228. Extending through the ledge 228 is a pair of openings 226 that accommodate throughput of the fasteners 246. On the underside of the ledge is a rib 230 that partially defines the second and third recess. More specifically, the openings 226 of the ledge 228 provide communication between the first recess and the second and third recesses. At the same time, the second and third recesses are formed to accommodate precise insertion of a fastener 246. Adjacent the openings 226 through the ledge 228 are a pair of cylindrical cavities 232 that are on opposing sides of the walls delineating the opening 218. As will be discussed in more detail hereafter, these cavities 232 are sized to receive a portion of the repositionable ball retainer 222 in order to mount the repositionable ball retainer to the chassis 210.

Figure 15:
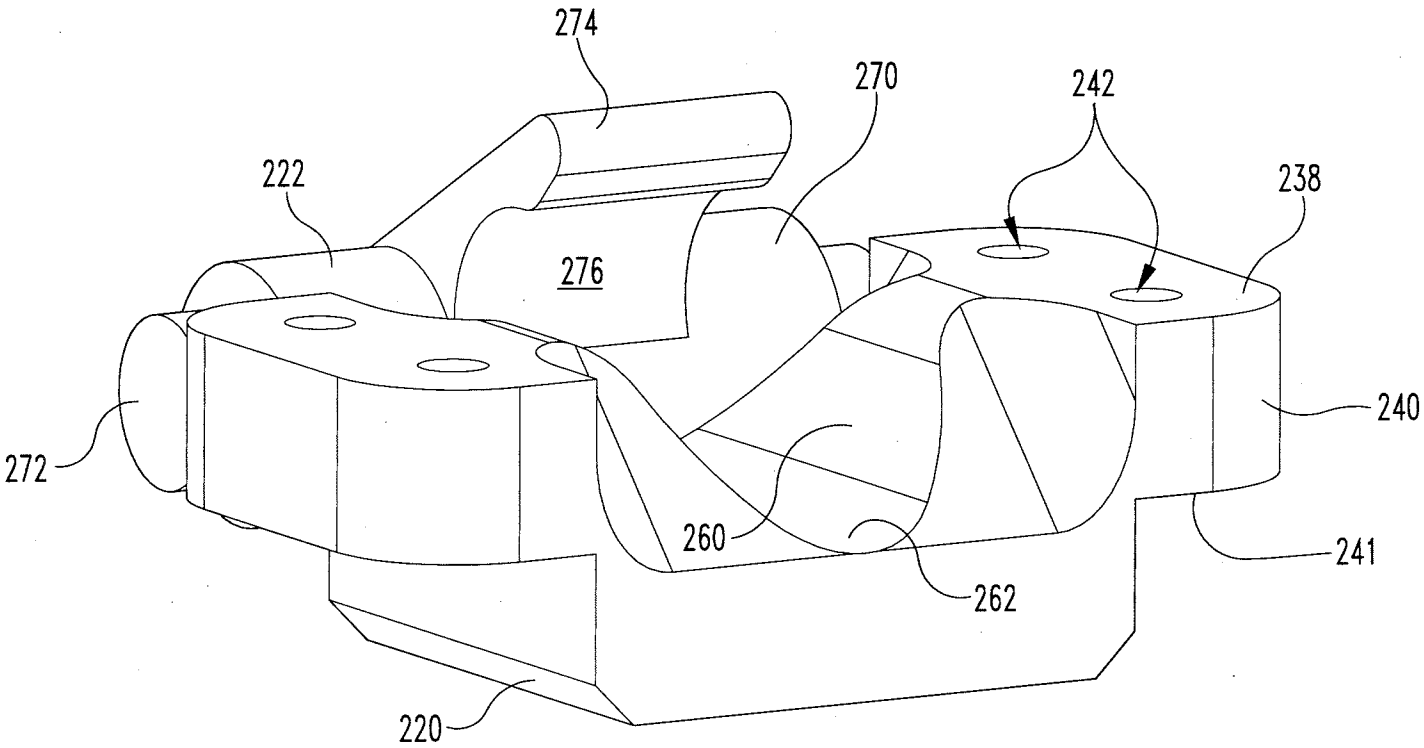
FIG. 15 is an elevated perspective view from above of the insert and the repositionable ball retainer shown in FIG. 9.
Figure 17:
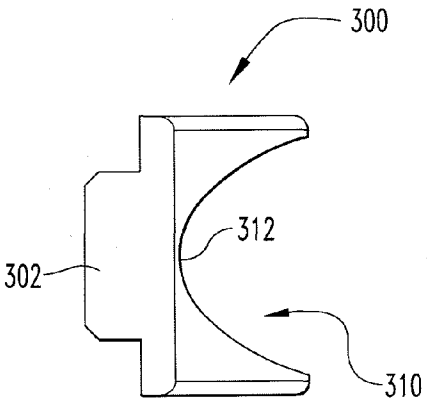
FIG. 17 is a profile view of the groove insert shown in FIG. 16.
Figure 16:
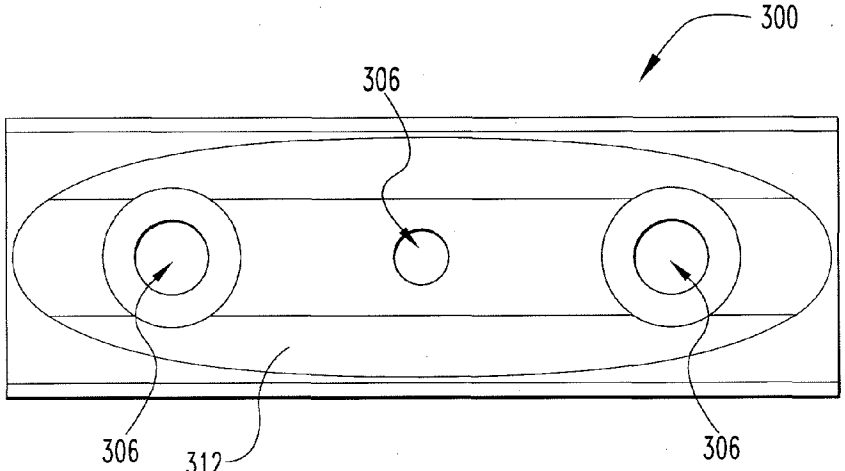
FIG. 16 is a frontal view of the groove insert shown in FIG. 9.
Figure 18:
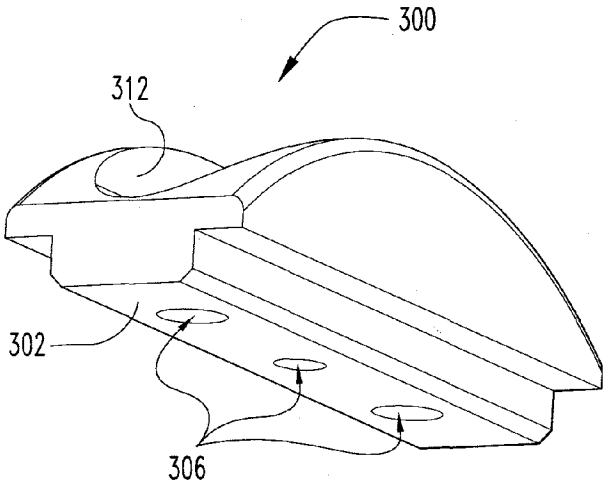
FIG. 18 is a recessed perspective view from below of the groove insert of FIG. 16.
Figure 19:
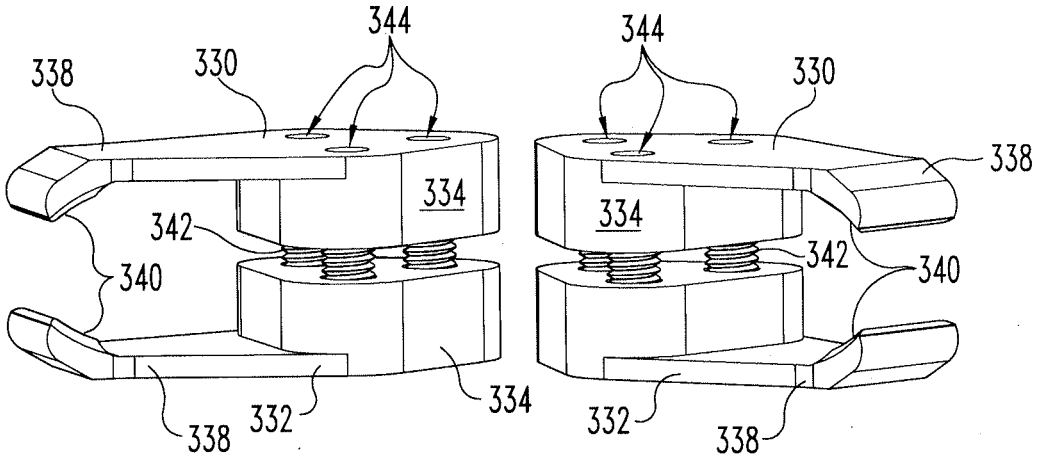
FIG. 19 is an elevated perspective view of a pair of upper and lower control arms as shown in FIG. 9.
Figure 20:
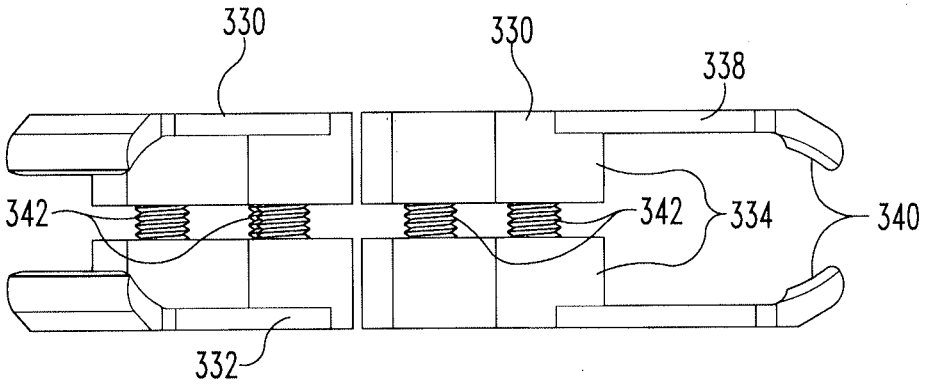
FIG. 20 is a profile view of the pair of upper and lower control arms of FIG. 19.

Referring to FIG. 15, the exemplary flush insert 220 and a repositionable ball retainer 222 are configured to be positioned adjacent one another within the opening 218. The flush insert 220 includes a top planar surface 238 that partially delineates a pair of spaced apart overhangs 240. In exemplary form, a bottom surface 241 of each overhang 240 is configured to contact and sit upon a corresponding ledge 228 when the inset 220 is properly mounted to the chassis 210. When properly mounted to the chassis 210, the top surface 238 of the insert 220 is substantially flush with the top surface 219 of the proximal portion 216. In order to mount the insert 220 to the chassis 210, four fasteners (e.g., threaded screws) 246 are utilized. Specifically, the shank of the fasteners is fed into either the second or third recess 252, 254, through the openings 226 of the ledge 228 and into the threaded openings 242 of the insert. Rotation of the fasteners 246 is carried out to complete mounting the insert 220 to the chassis 210.

In exemplary form, the dimensions of the overhang 240 match the dimensions of the first recess 250 so that the components fit precisely together, analogous to pieces of a puzzle. Interposing the overhangs 240 is a sloped depression delineated by an arcuate surface 260. In particular, the slope and dimensions of the arcuate surface 260 are configured to match the dimensions of the sphere 188 so that when the insert receives the sphere 188 (when coupling the ancillary device frame 140 is properly mounted to the firearm frame 150) the sphere contacts the bottom or trough 262 and the equator of the sphere also contacts the arcuate surface. In this manner, the sphere 188 is restricted from any lateral movement when received properly within the insert 220. In other words, when the sphere 188 is properly positioned to reside against the insert 220, there are multiple contact points between the sphere and insert.

In order to further restrict movement of the sphere 188 received within the insert 220, the repositionable ball retainer 222 is utilized. In exemplary form, the repositionable ball retainer 222 includes a cylindrical section 270 that includes a pair of smaller cylinders 272 that project from opposing lateral ends of the cylindrical section. Each smaller cylinder 272 is sized to be received within a corresponding cylindrical cavity 232 within the chassis 210 that allows the repositionable ball retainer 222 to rotate along a central axis that extends through the smaller cylinders. This rotation is useful in combination with a catch 274, extending from the cylindrical section 270, in order to secure a sphere 188 of a ball stud 180 within the proximal portion 216 of the firearm frame 150. The catch 274 includes an arcuate surface 276 that is configured to match the dimensions of the sphere 188 so that when the sphere is properly aligned received by the insert 220, the catch can be rotated so that the arcuate surface contacts the sphere to inhibit proximal-to-distal movement of the sphere (and ancillary device frame 140) with respect to the insert (and firearm frame 150). Likewise, rotation of the catch 274, so that the arcuate surface 276 contacts the outer surface of the sphere 188, is also operative to inhibit vertical upward motion of the sphere (whereas vertical downward motion of the sphere is prohibited by the sphere contacting the bottom surface 262 of the insert 220). In this manner, the insert 220 and the repositionable ball retainer 222 work together to capture and selectively release a sphere 188 of one of the ball studs 180 in order to secure the ancillary device frame 140 to the firearm frame 150. In addition, when the sphere 188 is properly positioned to reside against the arcuate surface 276 of the catch 274, there are multiple contact points between the sphere and catch.

As shown in FIGS. 9-14, the chassis 210, similar to that of the ancillary device chassis, widens in lateral width from proximal to distal. But, the chassis 210 also tapers at its distal end 280 upon reaching a transition 282. At each transition 282, the chassis 210 includes a block U-shaped trench 284 delineated by a bottom surface 286 and a pair of upstanding walls 288. Extending through the bottom surface 286 is a plurality of threaded cavities 290. In this exemplary embodiment, the bottom surfaces 286 are angled 120 with respect to one another. Interposing the bottom surfaces 286 are rounded triangular openings 292 formed through the top and bottom surfaces 212, 214. The vertical, axial cross-section of these openings 292 is not uniform given that midway through the depth of the opening is a perimeter ring 294 that extends into the opening to reduce the cross-section of the openings.

Referring to FIGS. 9-11 and 16-18, a groove insert 300 is configured to be received within the U-shaped trench 284. In particular, the groove insert 300 is configured to receive the sphere 188 from a respective one of the ball studs 180 mounted to one of the raised projections 198. In exemplary form, the groove insert 300 includes a generally rectangular key 302 that is dimensioned to be received within the U-shaped trench 284 of the chassis 210 in order to allow movement of the insert with respect to the chassis along the longitudinal length of the trench, but disallow vertical motion (perpendicular motion against the walls 288). In order to fix the relative position of the insert 300 with respect to the chassis 210, the insert includes three through holes 306. The outermost holes 306 have a slightly larger diameter and include a circular cross-section that changes to provide a circumferential stop that prohibits a head of a retainer 320 from passing completely through the holes. A respective retainer 320 is inserted through a respective hole 306 so that the threads of the retainer can engage corresponding threads on the inside of the threaded cavities 290. In this manner the longitudinal position of the insert 300 is fixed with respect to the chassis 210.

The insert 300 also includes a semicircular profiled via 310 that is delineated by an arcuate surface 312. In this exemplary embodiment, the arcuate surface has a contour that matches the contour of the sphere 188 of the ball stud 180 mounted to a respective raised projection 198. Consequently, when the sphere 188 is properly positioned to reside partially within the via 310, there are multiple contact points between the sphere and the insert 300. But the insert 300 is not the only aspect that operates to facilitate proper positioning of the spheres 188 with respect to the chassis 210.

As shown in FIGS. 9-11, 19, and 20, the firearm frame 150 includes two pairs of upper and lower control arms 330, 332 that are mounted to the chassis 210 to constrain certain motion between the spheres 188 and the firearm frame 150. In particular, each control arm includes a rounded triangular base 334 having an outline that correlates to the interior dimensions of the rounded triangular openings 292. In this manner, the triangular base 334 is received within the rounded triangular openings 292 so as to prohibit play in any direction other than vertical. Integrally formed with the triangular base 334 is an arm 338 that extends away from the base and includes an interior arcuate surface 340. In this exemplary embodiment, the arcuate surface 340 matches the curvature of the spheres 188 so that when the spheres are properly aligned with respect to the arms 338, multiple points of contact exist therebetween.

In order to secure the upper and lower control arms 330, 332 to the chassis 210, each triangular base 334 includes three threaded orifices 344 to receive three respective threaded fasteners 342. In this exemplary embodiment, a pair of triangular bases 334 contacts and sandwiches the perimeter ring 294 therebetween when the threaded fasteners 342 are used to couple the arms 330, 332 to the chassis 210. When mounted to the chassis 210, in addition to the inserts 300, the control arms 330, 332 and inserts partially delineate a circular profile that inhibits movement of the spheres (mounted to the raised projections 198) in any direction other than longitudinally along the via 310.

Figure 21:
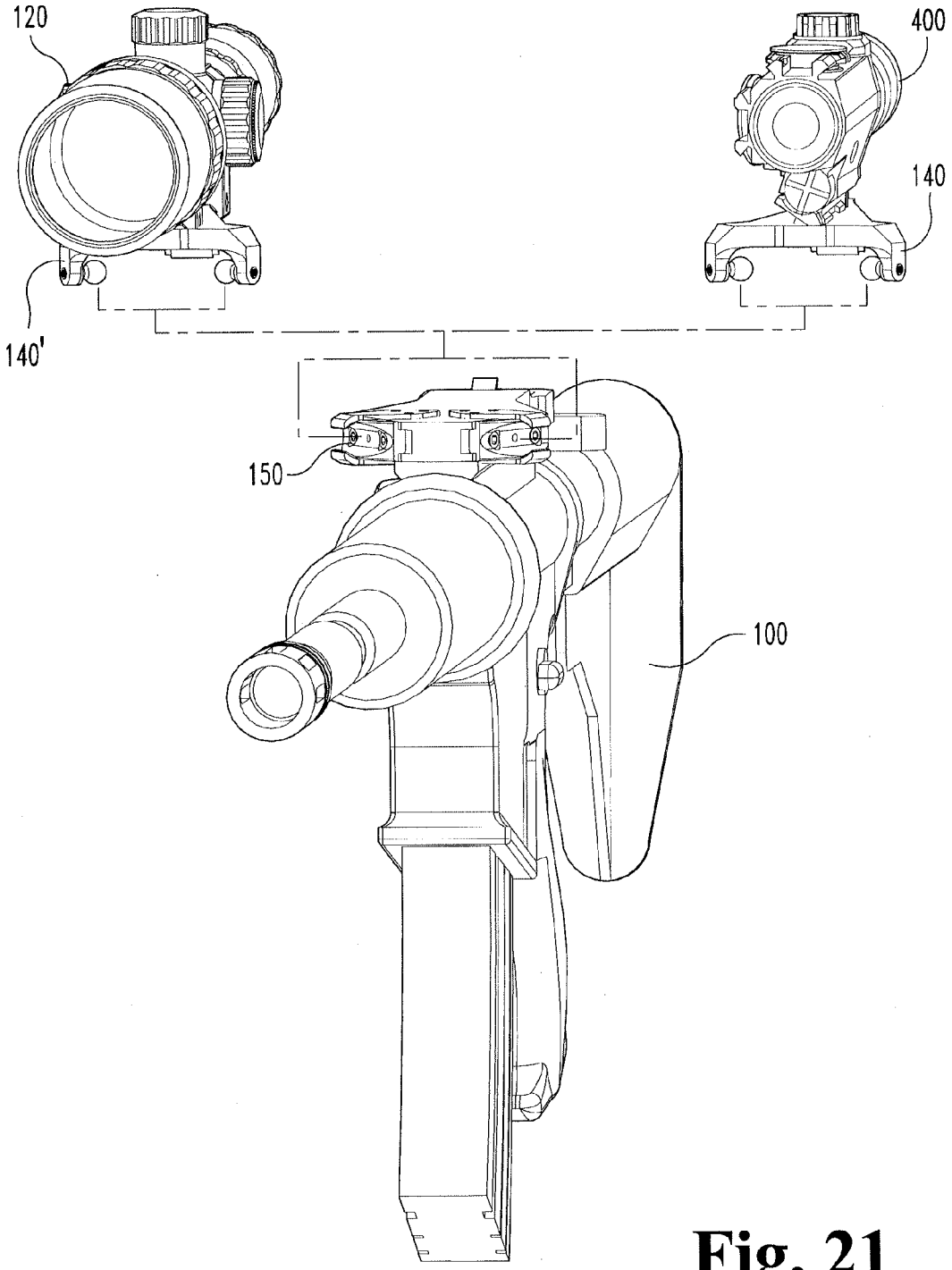
FIG. 21 is a proximal elevated perspective view a firearm and two ancillary components that may be mounted thereto using the exemplary mount of the instant disclosure.

Referring to FIGS. 1 and 21-29, an exemplary process for mounting and dismounting the ancillary device frame 140 from the firearm frame 150 will now be described. As shown in FIG. 21, the exemplary firearm 100 has mounted to it the firearm frame 150. In this manner, the firearm frame 150 is ready to receive an ancillary device frame 140 that is mounted to an ancillary device. In this exemplary circumstance, multiple ancillary device frames 140', 140" are provided, where each frame is mounted to a different ancillary device 120, 400. More specifically, the first ancillary device frame 140' is mounted to a rifle scope 120, while the second ancillary device mount frame 140" is mounted to a laser system 400. In this manner, the laser system 400 may be swapped out for the rifle scope 120 in quick fashion using a few simple steps. More than two ancillary devices may be temporarily mounted (or permanently mounted) to its own ancillary device mount frame 140, thereby allowing swapping out of ancillary devices very quickly.

Figure 22:
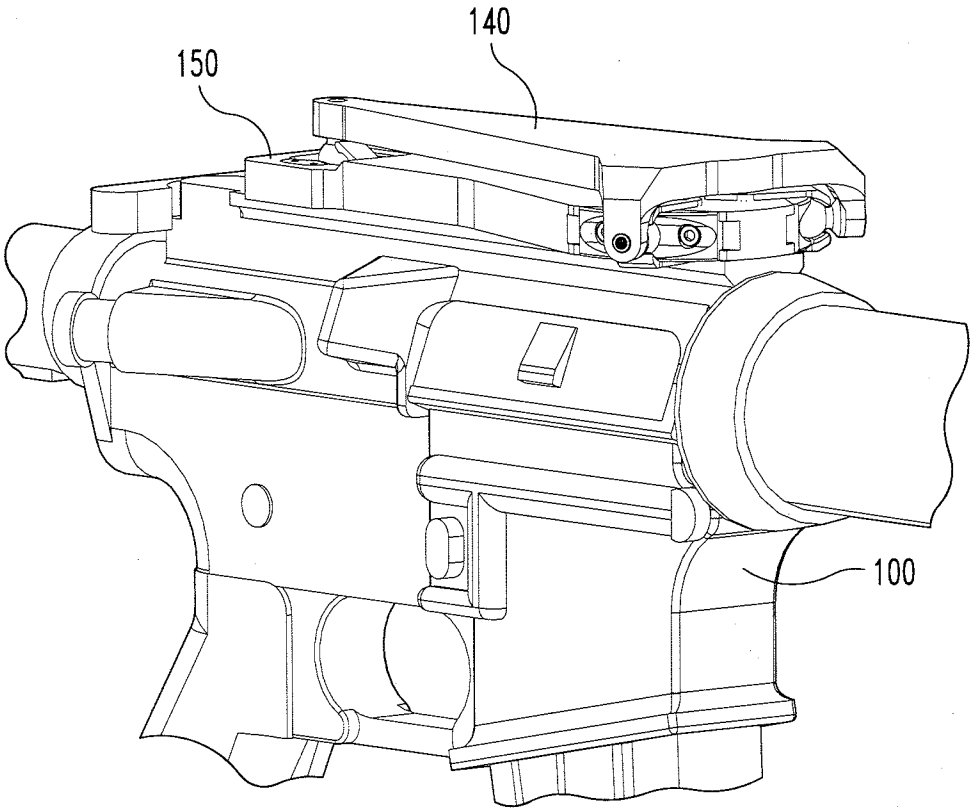
FIG. 22 is a distal elevated perspective view a portion of a firearm and showing the exemplary mount of the instant disclosure being mounted thereto.

As shown in FIG. 22, an ancillary device frame 140 is shown mounted to a firearm frame 150 that has been previously mounted to a firearm 100. In this mounted configuration, the orientation and position of the ancillary device frame 140 with respect to the firearm frame 150 has been locked. Not only that, but this single locked position is the only position where the frames may be coupled together properly. In particular, the spheres 188 of the ball studs 180 mounted to the raised projections 198 are partially surrounded by the inserts 300 and the control arms 330, 332 so as not to allow movement of the sphere in any direction other than longitudinally along the via 310 or rotationally. Similarly, the sphere 188 of the ball stud 180 mounted near the proximal end 166 of the ancillary device frame 140 is restrained concurrently by the insert 220 and the repositionable ball retainer 222. When in this position, the sphere 188 is inhibited from traveling vertically and distally (toward the other end of the frame 140). But rotational motion is still possible when the retention is just the insert 220 and the repositionable ball retainer 222. When one teams these retention devices together, the net result is that the ancillary device frame 140 is not repositionable with respect to the firearm frame 150 in any direction (expect for when the repositionable ball retainer 222 is repositioned to allow vertical motion of the sphere 188). FIG. 22 shows the position of these components when the ancillary device frame 140 is properly positioned and locked to the firearm frame 150.

Figure 23:
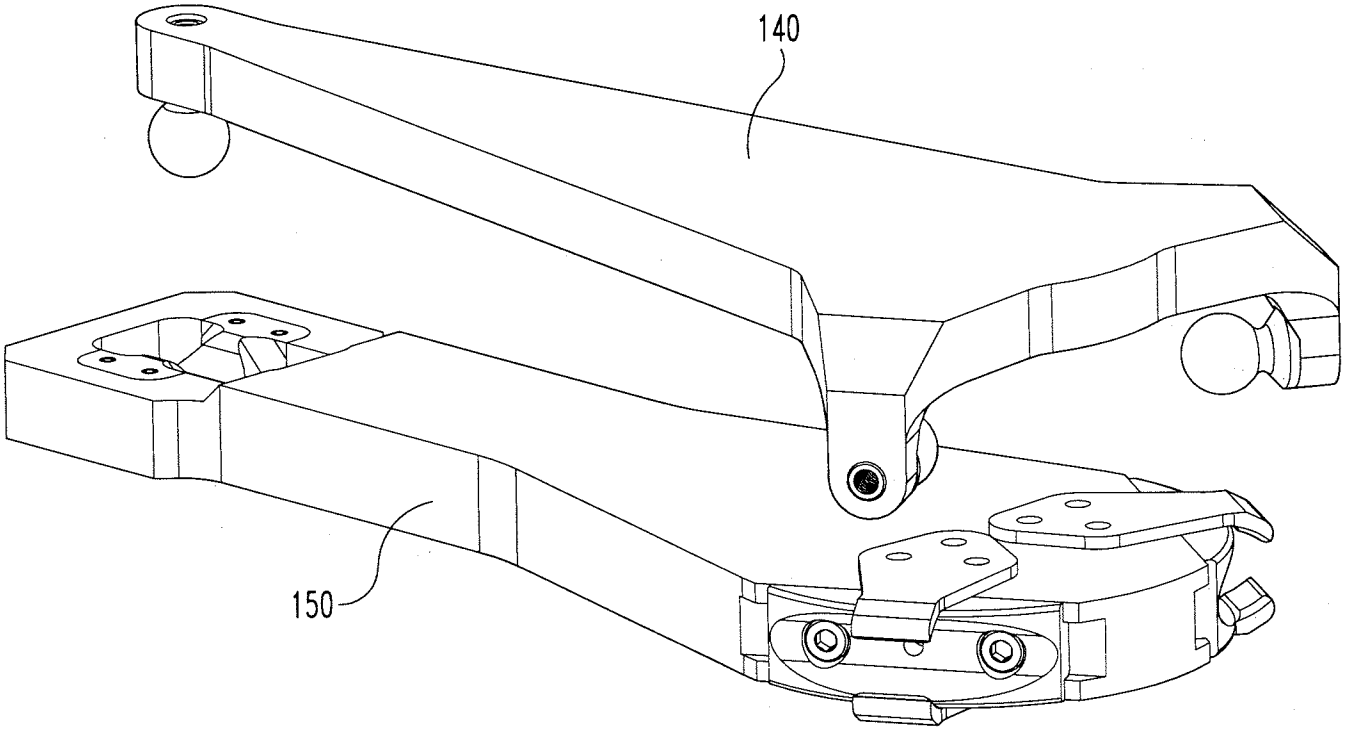
FIG. 23 is a distal elevated perspective view of the exemplary mount, disengaged, of the instant disclosure.
Figure 24:
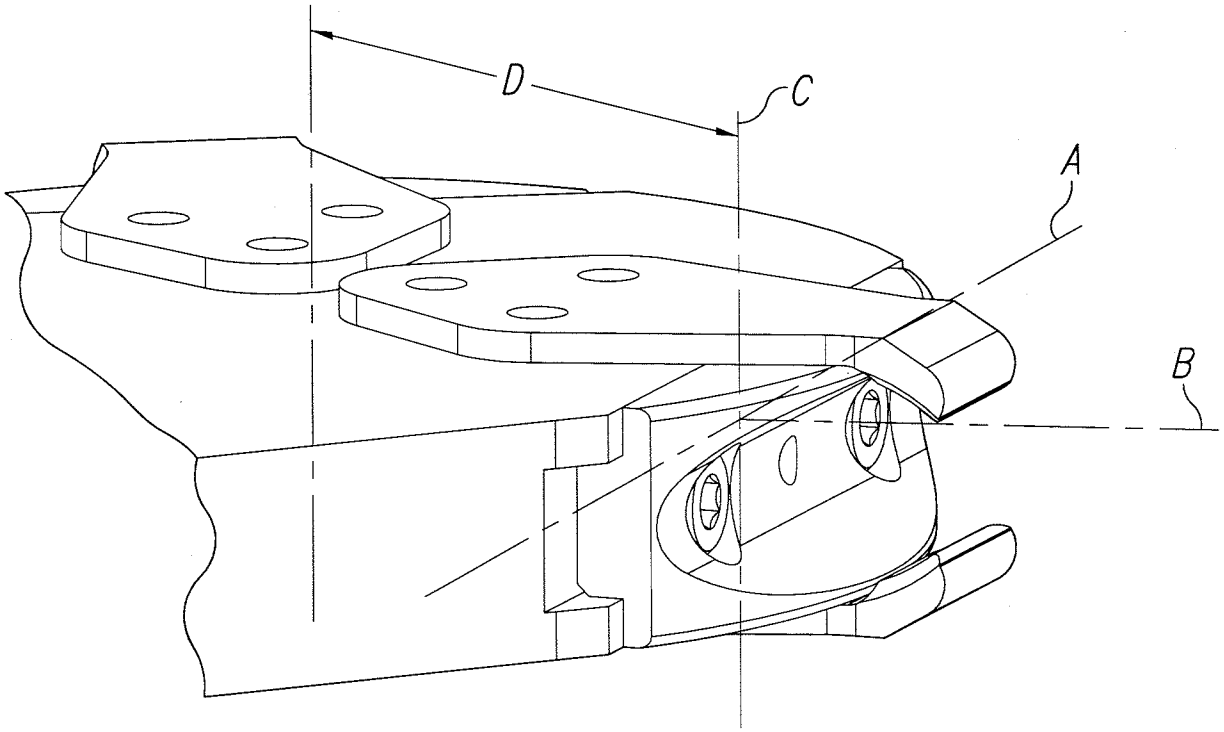
FIG. 24 is a magnified view showing a distal portion of the other component of FIG. 9.

As shown in FIG. 23, in order to mount the ancillary device frame 140 to the firearm frame 150, it is presumed for explanation that the two frames are dismounted from one another. As shown in FIG. 24, when the ancillary frame 140 is not mounted to the firearm frame 150, there is a first longitudinal axis (horizontal axis) A, a first rotational axis B, a first vertical axis C, and a radial arm distance D between where the axes A, B, C converge and a point on the frame chassis 210.

Figure 25:
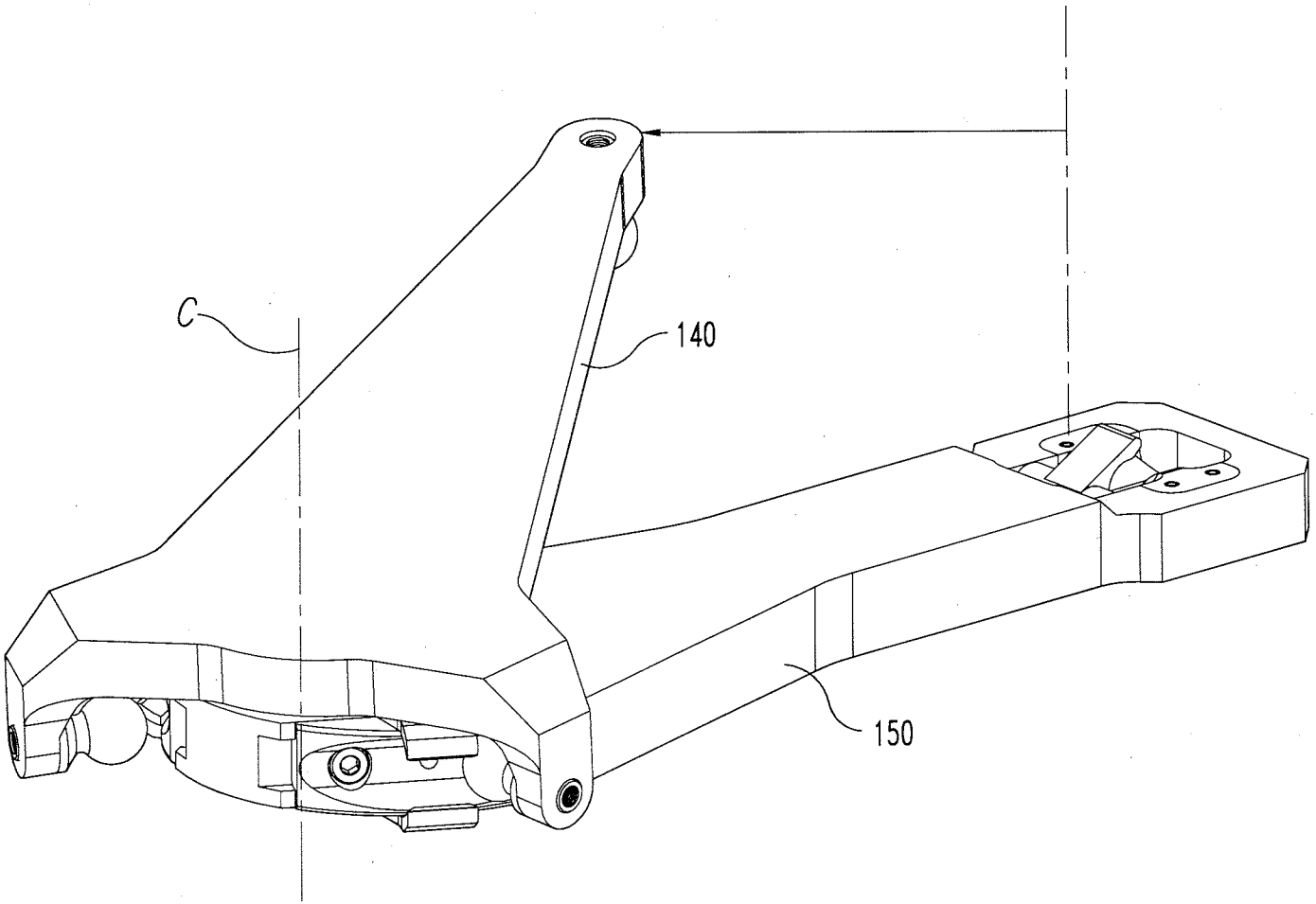
FIG. 25 is a distal elevated perspective view of the exemplary components of the exemplary mount assuming a position to facilitate mounting the components to one another.
Figure 26:
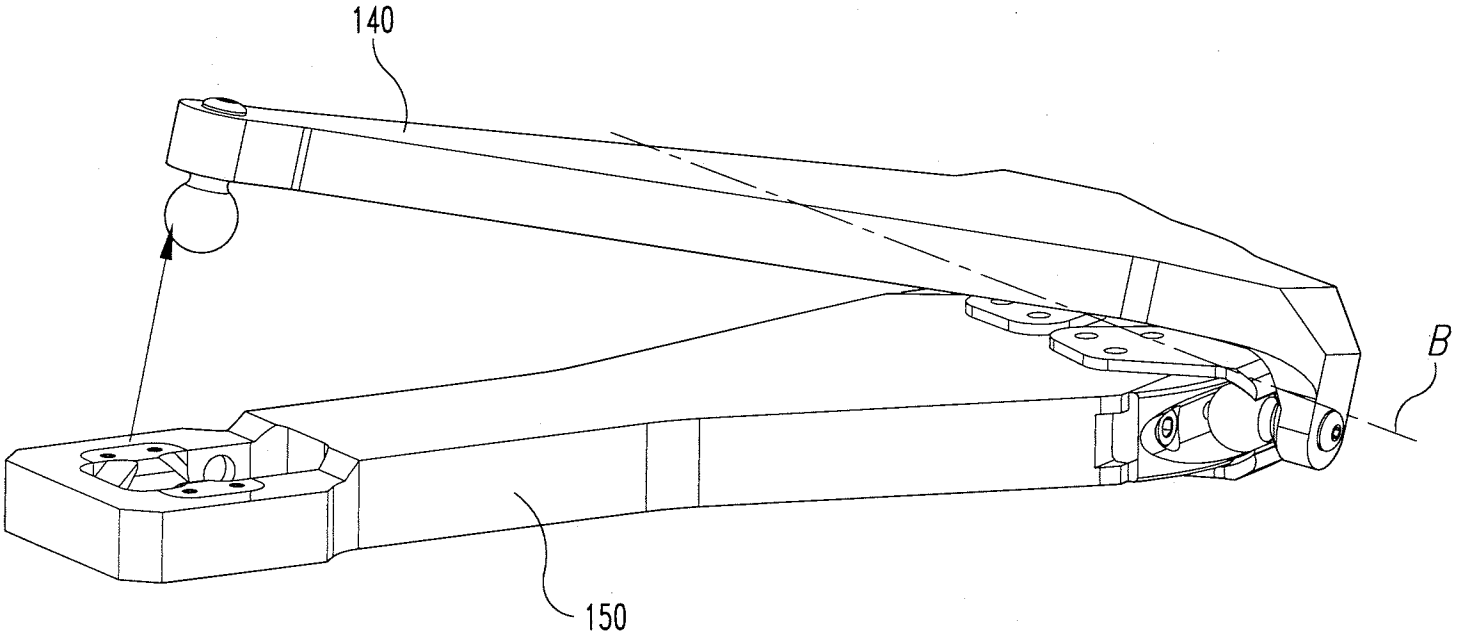
FIG. 26 is a proximal elevated perspective view of the exemplary components of the exemplary mount after a portion of the component parts have engaged one another.

One may begin mounting the ancillary device frame 140 to the firearm frame 150 by orienting the frames as shown in FIG. 25. In this orientation, the ancillary device frame 140 is lowered vertically so that the spheres 188 are aligned with the via 310. After this has been accomplished, the ancillary device frame 140 is rotated about the vertical axis C with respect to the firearm frame 150 to reach the position shown in FIG. 26. While in the position of FIG. 26, the ancillary device frame 140 may be rotated or pivoted around the rotational axis B to move the proximal portion of the ancillary device frame up and down vertically with respect to the firearm frame 150.

Figure 27:
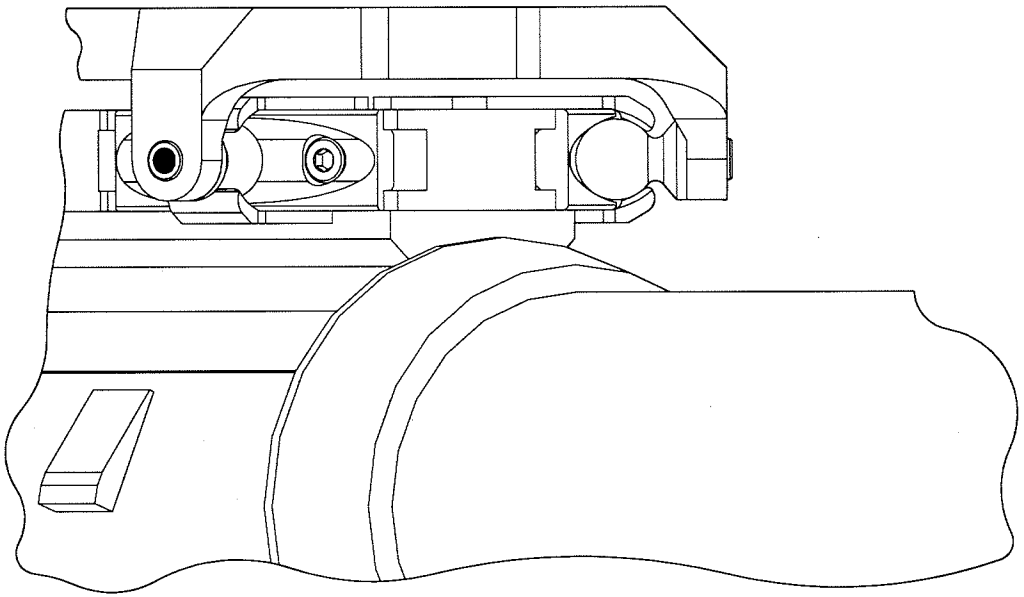
FIG. 27 is a distal profile view showing the engagement of the portion of the component parts in FIG. 26.
Figure 29:
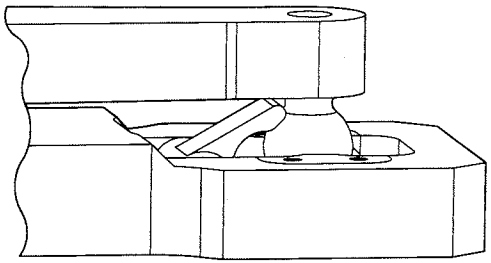
FIG. 29 is an elevated perspective view showing proximal portions of the exemplary mount engaging one another.
Figure 28:
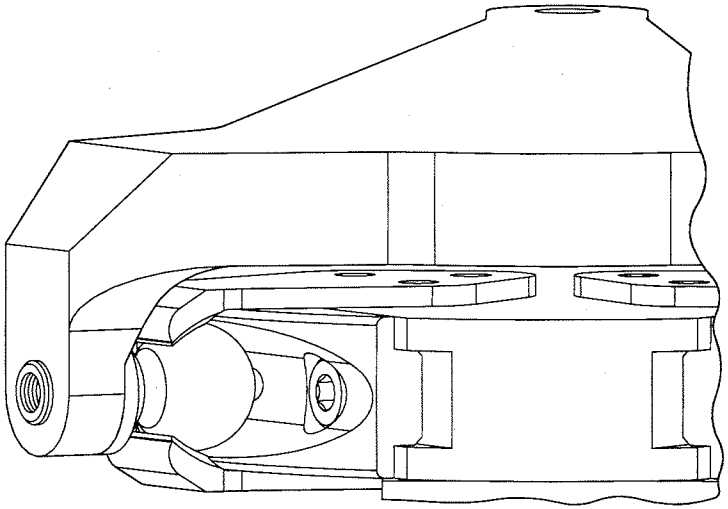
FIG. 28 is a distal elevated perspective view showing the engagement of a portion of the component parts in FIG. 26.
Figure 30:
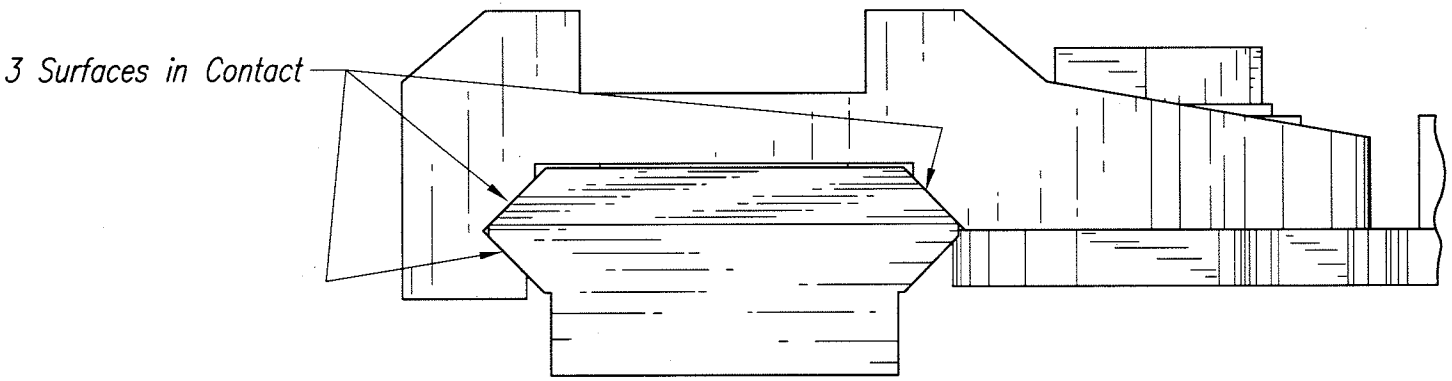
FIG. 30 is a prior art mount.

Next, as shown in FIGS. 27-29, the ancillary device frame 140 is rotated or pivoted around the rotational axis B (while the repositionable ball retainer 222 is out of the line of travel of the counterpart sphere 188) so that the sphere 188 contacts the bottom surface 262 of the insert 220. At this time, the repositionable ball retainer 222 is repositioned into the line of travel of the counterpart sphere 188 (see FIG. 29), thereby inhibiting vertical travel of the sphere with respect to the retainer. In this configuration, as shown in FIGS. 22 and 27-29, the position of the ancillary device frame 140 and the firearm frame 150 is locked. Likewise, it should be noted that in this configuration, there is only one three dimensional position where the frames can be properly locked together. Consequently, if the frames are later disengaged and thereafter mounted to one another, one can be assured that the position of the frames each time the frames are properly locked is exactly the same.

Each of the foregoing components may be fabricated from any desired material such as, without limitation, metal(a)s, metal alloy(s), composite(s), ceramic(s), polymer(s), polymer alloy(s), or further material as known to those skilled in the art. By way of example, and not limitation, each of the foregoing components may be fabricated from steel and, more specifically, from stainless steel.

While the foregoing exemplary mount 130 has been described using spheres 188 and receivers (insert 220, repositionable ball retainer 222, upper and lower control arms 330, 332, and groove insert 300) that provide more than a single contact point at three locations, it is also within the scope of the disclosure to use devices other than spheres. For example, the spheres 188 of the ball studs 180 mounted to the raised projections 198 may be replaced with cylinders and the receivers be modified to accept the cylinders in a single orientation, while allowing the cylinders to optionally pivot or rotate (thereby along one frame to pivot or rotate with respect to the other frame). And the sphere 188 of the ball stud 180 may be replaced by any device that allows the device to be locked in position to inhibit the degree of freedom(s) (stright-line motion, angular motion, rotational motion, pivoting motion, etc.) allowed by the other engagement devices.

It is also within the scope of the disclosure to mount the frames to one another using projections and corresponding cavities that may only be aligned in a single manner. For instance, the ancillary device frame may include two or more triangular projections that are received within two or more triangular cavities formed within the firearm plate, or vice versa, or any combination thereof (each plate include at least one projection and at least one cavity). The projections and cavities may be machined with tight tolerances so that the engagement between the projection and cavities is operative to fix the orientation and position of the frames with respect to one another.

In view of the above, the exemplary mount has been described to include two frames that are selectively coupled to form a mount and thereby attach a first device (e.g., a firearm) to a second device (e.g., a rifle scope, light, laser sight, further weapon, etc.) with repeatable precision as to position and orientation. It should be understood, however, that the frame may be formed in multiple pieces and continue to be within the scope of the disclosure.

In addition, the exemplary mount 130 has been described so that the pivoting occurs at the distal end and the vertical motion occurs at the proximal end. It should be understood, however, that the mount may be repositioned and mounted to the two other devices so that the reference to proximal and distal might not apply. What is important, however, is that the plates are configured to disengage and reengage where the position achieved through reengagement is the same as the position prior to disengagement.

Following from the above description and invention summaries, it should be apparent to those of ordinary skill in the art that, while the methods and apparatuses herein described constitute exemplary embodiments of the present invention, the invention is not limited to the foregoing and changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A kinematic coupling mounting device for mounting an ancillary device to a firearm, the mounting device comprising:

an ancillary device frame mounted to the ancillary device;

a firearm frame mounted to the firearm;

a first projection and a first receiver, the ancillary device frame including the first projection and the firearm frame including the first receiver, the first receiver configured to engage the first projection and restrict motion of the first projection in at least one degree of freedom;

a second projection and a second receiver, the ancillary device frame including the second projection and the firearm frame including the second receiver, the second receiver configured to engage the second projection and restrict motion of the second projection in at least one degree of freedom;

a third projection and a third receiver, the ancillary device frame including the third projection and the firearm frame including the third receiver, the third receiver configured to engage the third projection and restrict motion of the third projection;

wherein the first, second and third projections are mounted in a triangular configuration and the internal angles of the triangular configuration at the first and second projections are substantially equal;

wherein the firearm frame includes a top surface and a side surface substantially perpendicular to the top surface, the top surface including the third receiver and the side surface including the first and second receivers; and the ancillary device frame includes a top surface, a first support arm and a second support arm, the top surface including the third projection, the first support arm including the first projection and the second support arm including the second projection; and wherein the ancillary device frame and the firearm frame can be coupled and decoupled repeatedly, and each time the ancillary device frame is coupled to the firearm frame, the first, second and third projections and the first, second and third receivers cause the ancillary device frame and the firearm frame to have the same orientation and position with respect to each other, the ancillary device frame and the firearm frame not being adjustable relative to one another when coupled.

2. The kinematic coupling mounting device of claim 1, wherein:

the first projection is part of a first ball stud; and the second projection is part of a second ball stud.

3. The kinematic coupling mounting device of claim 2, wherein:

the third projection includes a third ball stud.

4. The kinematic coupling mounting device of claim 1, wherein:

the first receiver is configured to restrict motion of the first projection in at least one of a first direction and a second direction perpendicular to the first direction; and the second receiver is configured to restrict motion of the second projection in at least one of a the first direction and the second direction perpendicular to the first direction.

5. The kinematic coupling mounting device of claim 4, wherein:

the first receiver is configured to restrict motion of the first projection in the first direction and allow motion of the first projection in the second direction perpendicular to the first direction and rotational motion of the first projection; and the second receiver is configured to restrict motion of the second projection in the first direction and allow motion of the second projection in the second direction perpendicular to the first direction and rotational motion of the second projection.

6. The kinematic coupling mounting device of claim 5, wherein:

the first projection is part of a first ball stud removably coupled to the ancillary device frame; and the second projection is part of a second ball stud removably coupled to the ancillary device frame.

7. The kinematic coupling mounting device of claim 6, wherein the third projection is part of a third ball stud.

8. The kinematic coupling mounting device of claim 7, wherein the third ball stud is removably coupled to the ancillary device frame.

9. The kinematic coupling mounting device of claim 7, wherein:

the third ball stud includes a sphere;

the third receiver includes an arcuate surface to contact the sphere on more than one peripheral location on an exterior of the sphere; and the first, second and third projections are mounted in a triangular configuration and the internal angles of the triangular configuration at the first and second projections are substantially equal.

10. The kinematic coupling mounting device of claim 9, wherein:

the arcuate surface comprise multiple surfaces from multiple components.

11. The kinematic coupling mounting device of claim 1, wherein:

the first projection is a first ball stud including a first sphere, the first ball stud being attached to the first support arm at a first attachment location, a first central axis passing through the center of the first sphere and through the center of the first attachment location;

the second projection is a second ball stud including a second sphere, the second ball stud being attached to the second support arm at a second attachment location, a second central axis passing through the center of the second sphere and through the center of the second attachment location; and the third projection is a third ball stud including a third sphere, the third ball stud being attached to the top surface of the ancillary device frame at a third attachment location, a third central axis passing through the center of the third sphere and through the center of the third attachment location.

12. The kinematic coupling mounting device of claim 1, wherein at least one of the first, second and third projections include a cylinder.

13. The kinematic coupling mounting device of claim 1, wherein at least one of the first, second and third projections includes a portion of a sphere.

14. A kinematic coupling mounting device for mounting an ancillary device to a firearm, the mounting device comprising:

an ancillary device frame mounted to the ancillary device, the ancillary device frame including a first projection and a second projection;

a firearm frame mounted to the firearm, the firearm frame including a first receiver and a second receiver, the first receiver being configured to engage the first projection and restrict motion of the first projection in at least one degree of freedom, the second receiver being configured to engage the second projection and restrict motion of the second projection in at least one degree of freedom;

a third projection and a third receiver, the third projection forming part of one of the ancillary device frame or the firearm frame and the third receiver forming part of the other of the ancillary device frame or the firearm frame, the third receiver configured to engage the third projection and restrict motion of the third projection;

wherein the first receiver is configured to restrict motion of the first projection in a first direction and allow motion of the first projection in a second direction perpendicular to the first direction and rotational motion of the first projection; and the second receiver is configured to restrict motion of the second projection in the first direction and allow motion of the second projection in the second direction perpendicular to the first direction and rotational motion of the second projection, wherein the first receiver includes a first pair of control arms at least partially defining a first cylindrical channel configured to slidably receive the first projection; and the second receiver includes a second pair of control arms at least partially defining a second cylindrical channel configured to slidably receive the second projection;

wherein the ancillary device frame and the firearm frame can be coupled and decoupled repeatedly, and each time the ancillary device frame is coupled to the firearm frame, the first, second and third projections and the first, second and third receivers cause the ancillary device frame and the firearm frame to have the same orientation and position with respect to each other, the ancillary device frame and the firearm frame not being adjustable relative to one another when coupled.

15. The kinematic coupling mounting device of claim 14, wherein:

the first cylindrical channel is at least partially delineated by a first insert mounted to the firearm frame; and the second cylindrical channel is at least partially delineated by a second insert mounted to the firearm frame.

16. The kinematic coupling mounting device of claim 14, wherein the first cylindrical channel includes a first longitudinal central axis and the second cylindrical channel includes a second longitudinal central axis, the first longitudinal central axis being angled greater than zero degrees and less than one hundred and eighty degrees with respect to the second longitudinal central axis.

17. The kinematic coupling mounting device of claim 14, wherein the first projection is part of a first ball stud including a first sphere and a first cylindrical section for mounting the first sphere to the ancillary device frame, a first central axis passing through the first cylindrical section and the center of the first sphere;

the second projection is part of a second ball stud including a second sphere and a second cylindrical section for mounting the second sphere to the ancillary device frame, a second central axis passing through the second cylindrical section and the center of the second sphere;

the first central axis being angled greater than zero degrees and less than one hundred and eighty degrees with respect to the second central axis.

18. The kinematic coupling mounting device of claim 14, wherein:

the first pair of control arms are removably coupled to the firearm frame; and the second pair of control arms are removably coupled to the firearm frame.

19. The kinematic coupling mounting device of claim 14, wherein:

the first projection includes a first ball stud; and the second projection includes a second ball stud.

20. The kinematic coupling mounting device of claim 19, wherein:

the third projection includes a third ball stud.

21. The kinematic coupling mounting device of claim 20, wherein:

the third ball stud includes a sphere; and the third receiver includes an arcuate surface to contact the sphere on more than one peripheral location on an exterior of the sphere.

22. The kinematic coupling mounting device of claim 21, wherein:

the arcuate surface comprise multiple surfaces from multiple components.

23. The kinematic coupling mounting device of claim 14, wherein:

the third receiver is associated with the firearm frame;

the third projection is associated with the ancillary device frame; and the first, second and third projections are mounted in a triangular configuration and the internal angles of the triangular configuration at the first and second projections are substantially equal.

24. The kinematic coupling mounting device of claim 14, wherein at least one of the first, second and third projections include a cylinder.

25. The kinematic coupling mounting device of claim 14, wherein at least one of the first, second and third projections includes a portion of a sphere.

* * * * *